US006648738B2

(12) United States Patent
Eto et al.

(10) Patent No.: US 6,648,738 B2
(45) Date of Patent: Nov. 18, 2003

(54) GRINDING FLUID SUPPLY DEVICE OF LENS GRINDING APPARATUS

(75) Inventors: Yasuhito Eto, Tokyo (JP); Kenichi Watanabe, Tokyo (JP); Yoshiyuki Hatano, Tokyo (JP)

(73) Assignee: Kabushiki Kaisha TOPCON, Tokyo (JP)

( * ) Notice: Subject to any disclaimer, the term of this patent is extended or adjusted under 35 U.S.C. 154(b) by 115 days.

(21) Appl. No.: 10/060,500

(22) Filed: Jan. 30, 2002

(65) Prior Publication Data

US 2002/0102930 A1 Aug. 1, 2002

(30) Foreign Application Priority Data

Jan. 31, 2001 (JP) ..... 2001-024004

(51) Int. Cl.[7] ..... B24B 5/00

(52) U.S. Cl. ..... 451/254; 451/255; 451/256; 451/449; 451/450

(58) Field of Search ..... 451/254, 255, 451/256, 449, 450, 41

(56) References Cited

U.S. PATENT DOCUMENTS

| | | | | | |
|---|---|---|---|---|---|
| 2,434,679 | A | * | 1/1948 | Wagner et al. | 451/7 |
| 2,716,914 | A | * | 9/1955 | Pigott | 82/152 |
| 2,716,915 | A | * | 9/1955 | Biber | 82/152 |
| 3,334,451 | A | * | 8/1967 | Hutton | 451/450 |
| 3,543,451 | A | * | 12/1970 | Smith | 451/450 |
| 4,080,952 | A | * | 3/1978 | Wain | 125/13.01 |
| 4,176,500 | A | * | 12/1979 | Bourgoin | 451/450 |
| 4,392,334 | A | * | 7/1983 | Tusinski et al. | 451/446 |
| 4,414,783 | A | * | 11/1983 | Vincent | 451/450 |
| 4,501,258 | A | * | 2/1985 | Dyer et al. | 125/13.02 |
| 4,502,459 | A | * | 3/1985 | Dyer | 125/13.02 |
| 4,619,081 | A | * | 10/1986 | Lipanski | 451/450 |
| 4,751,796 | A | * | 6/1988 | Ueda et al. | 451/450 |
| 6,105,567 | A | * | 8/2000 | Sun et al. | 125/13.01 |
| 6,305,183 | B1 | * | 10/2001 | Mukai et al. | 62/376 |
| 6,328,636 | B1 | * | 12/2001 | Yoshimi et al. | 451/56 |

FOREIGN PATENT DOCUMENTS

| | | | | |
|---|---|---|---|---|
| DE | 3503009 A1 | * | 7/1986 | B24B/55/02 |
| JP | 60-227223 | | 11/1985 | G02C/3/00 |
| JP | 61-8273 | | 1/1986 | B24B/55/02 |
| JP | 03-202274 | | 9/1991 | B24B/55/02 |
| JP | 05-031669 | | 2/1993 | B24B/55/02 |
| JP | 09-225828 | | 9/1997 | B24B/55/02 |

* cited by examiner

*Primary Examiner*—Maurina T Rachuba
(74) *Attorney, Agent, or Firm*—Chapman and Cutler LLP

(57) ABSTRACT

Disclosed is a grinding fluid supply device of a lens grinding apparatus. The grinding fluid supply device includes first grinding fluid supply means for supplying a grinding fluid in a tangent direction of a circular grinding wheel, which has a grinding surface formed on its circumferential surface, with an interval above a grinding surface and allows an upper portion and a rear side portion of the grinding surface to be covered with a curtain of the grinding fluid spaced from the grinding wheel when a processed lens is subjected to a grind processing with the grinding surface of the grinding wheel by rotatively driving the grinding wheel around an axis; and second grinding fluid supply means for insufflating the grinding fluid to the grinding surface.

12 Claims, 12 Drawing Sheets

GRINDING FLUID SUPPLY DEVICE OF LENS GRINDING APPARATUS

BACKGROUND OF THE INVENTION

1. Field of the Invention

This invention relates to a lens grinding apparatus for grinding an unprocessed eyeglass lens with a grinding wheel based on lens shape data, particularly to a grinding fluid supply apparatus of the lens grinding apparatus for supplying grind fluid to the eyeglass lens or the grinding wheel.

2. Description of the Prior Art

As shown in Japanese Patent Laid-Open No. 9(1997)-225828, a lens grinding apparatus has been heretofore known, which grinds an unprocessed eyeglass lens as a material to be ground while supplying grinding fluid to a convex surface (font surface) or a concave surface (rear surface) of the eyeglass lens.

As shown in Japanese Patent Laid-Open Nos. 60(1985)-227223, 61(1986)-8273, 3(1991)-202274, and 5(1993)-31669, a grinding apparatus for an optical lens or the like has been known, in which grinding fluid is supplied to a contact position of a grinding wheel and an optical lens as a material to be ground from a tangent direction of the grinding surface of the grinding wheel.

However, in the above-described lens grinding apparatus, in some cases, the grinding fluid does not sufficiently spread over each of the eyeglass lens and the grinding surface of the grinding wheel because the grinding fluid is supplied to each of the convex (front) and the concave (rear) surfaces of the eyeglass lens.

In the grinding apparatus for an optical lens or the like, when the grinding apparatus is designed so that the grinding fluid directly lashes the grinding wheel, a cooling effect of eliminating frictional heat accompanied with the grinding can be sufficiently obtained, but the grinding fluid splashes with rotation of the grinding wheel and the optical lens as a material to be ground.

Particularly, in the grinding of the eyeglass lens or the like, the grinding fluid sometimes does not sufficiently spread over each of the eyeglass lens or the like and the grinding wheel because of a slight dislocation in a tangent direction between the grinding wheel and the eyeglass lens or the like as a material to be ground, and a shortage of the grinding fluid may occur. In other words, it is difficult to cope with a shift of a processing point of the grinding wheel caused by a difference in the finished shape (lens shape) of the eyeglass lens or the like, namely, a supply of the grinding fluid to such shifted processing point is difficult,

SUMMARY OF THE INVENTION

A first object of the present invention is to solve the above-described problem and provide a grinding fluid supply device of a lens grinding apparatus, in which, even when the grinding fluid is allowed to directly lash the grinding wheel, splashing of the grinding fluid can be prevented, and the sufficient grinding fluid can be supplied to both of the eyeglass lens which is a material to be ground and the grinding surface of the grinding wheel.

A second object of the present invention is to solve the problem that, particularly in the grinding of the eyeglass lens as a material to be ground or the like, the grind fluid sometimes does not sufficiently spread over each of the eyeglass lens or the like and the grinding wheel because of a slight dislocation in a tangent direction between the grinding wheel and the eyeglass lens or the like, thus leading to a shortage of the grinding fluid and to provide a grinding fluid supply device of a lens grinding apparatus, in which, even when the processing point of the grinding wheel is moved because of the difference in the finished shape (lens shape) of the eyeglass lens or the like, the grinding fluid can be supplied while following the moved processing point.

In order to achieve the objects, the grind fluid supply device of a lens grinding apparatus according to the present invention comprise first grinding fluid supply means for supplying a grinding fluid in a tangent direction of a circular grinding wheel, which has a grinding surface formed on its circumferential surface, with an interval above a grinding surface and allows an upper portion and a rear side portion of the grinding surface to be covered with a curtain of the grinding fluid spaced from the grinding wheel when a processed lens is subjected to a grind processing with the grinding surface of the grinding wheel by rotatively driving the grinding wheel around an axis; and second grinding fluid supply means for insufflating the grinding fluid to the grinding surface.

Herein, the first and the second grinding fluid supply means are integrally provided.

Moreover, the first grinding fluid supply means discharges the grinding fluid in an arc shape along the grinding surface.

Moreover, the second grinding fluid supply means insufflates the grinding fluid to the grinding surface from a normal direction.

Moreover, a width of the grinding fluid discharged from the first grinding fluid supply means is larger than that of the grinding fluid discharged from the second grinding fluid supply means.

Moreover, a width of the grinding fluid discharged from the second grinding fluid supply means is made approximately equal to that of the grinding surface or larger than that of the grinding surface.

Furthermore, third grinding fluid supply means is provided at a lower edge portion of a rear wall of a processing chamber where the grinding wheel is disposed. The third grinding fluid supply means discharges a grinding fluid to a bottom wall in a width direction of the bottom wall of the processing chamber and flows the discharged grinding fluid to the grinding wheel side along the bottom wall.

Still furthermore, the third grinding fluid supply means is a grinding fluid discharge nozzle provided at a center of the rear wall in a transverse direction.

BRIEF DESCRIPTION OF THE DRAWINGS

FIGS. 2A and 2B show the lens grinding apparatuses according to the embodiment of the present invention, wherein FIG. 2A is a perspective view thereof when a cover is closed; and FIG. 2B is a perspective view thereof when the cover is open.

FIG. 3A being a plan view thereof when the cover is closed; and FIG. 3B being a plan view thereof when the cover is open.

FIG. 4A being an enlarged explanatory view of a first operation panel; and FIG. 4B being a front view of a liquid crystal display.

FIG. 5A being a perspective view of a main processing portion of a processing chamber; and FIG. 5B being a sectional view of a cover plate of FIG. 5A.

DETAILED DESCRIPTION OF PREFERRED EMBODIMENTS

[Constitution]

Figure 1:
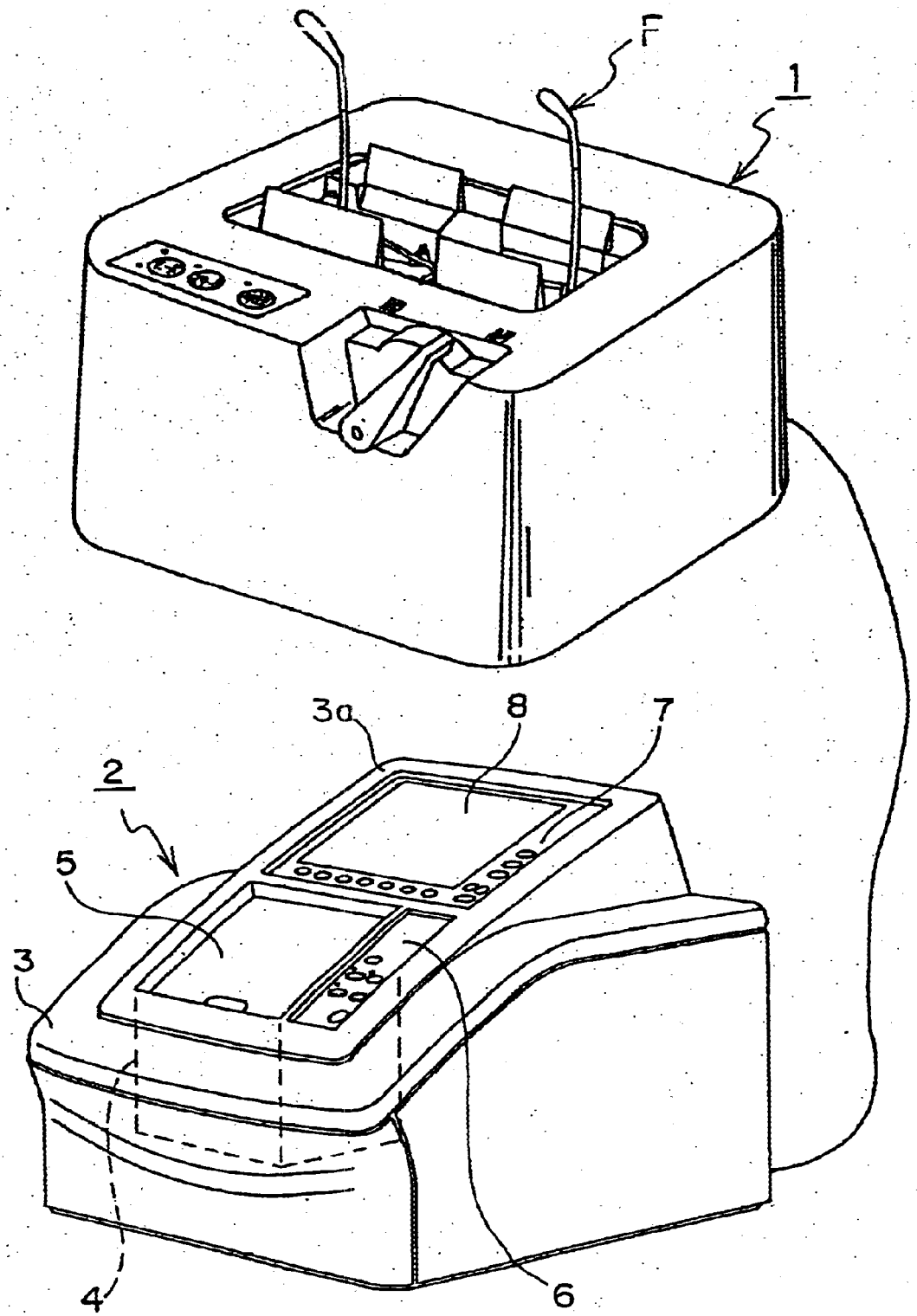
FIG. 1 is an explanatory view showing a relation between a lens grinding apparatus provided with a layout display apparatus according to an embodiment of the present invention and a frame shape measuring apparatus.
Figure 2A:
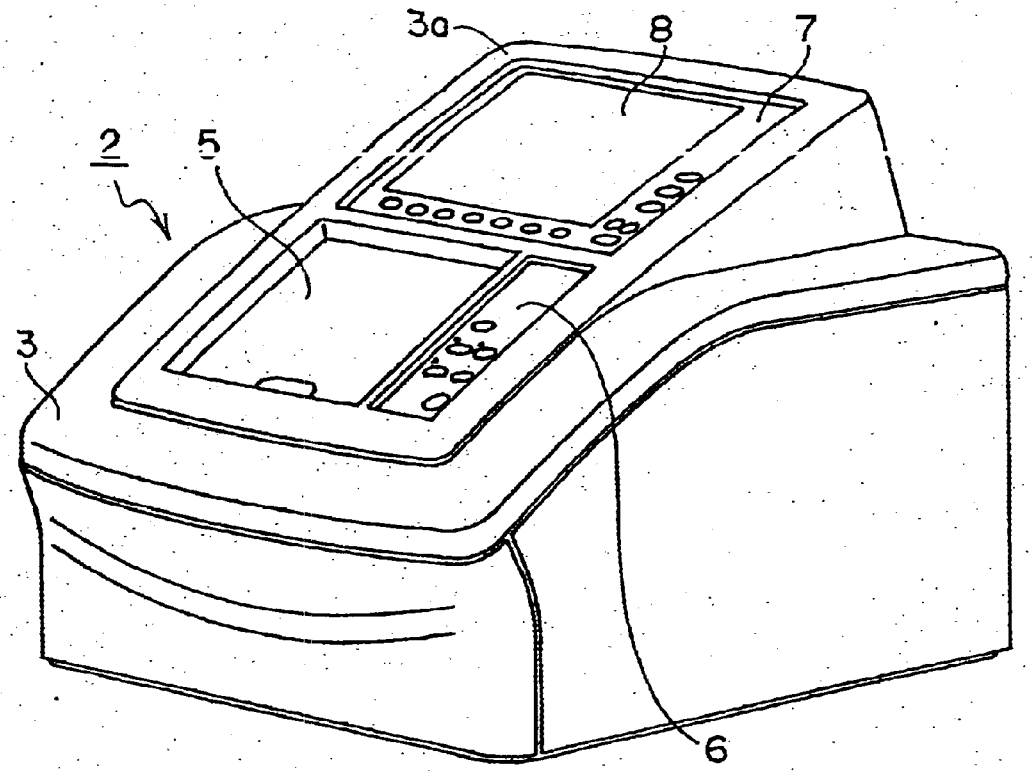
Figure 2B:
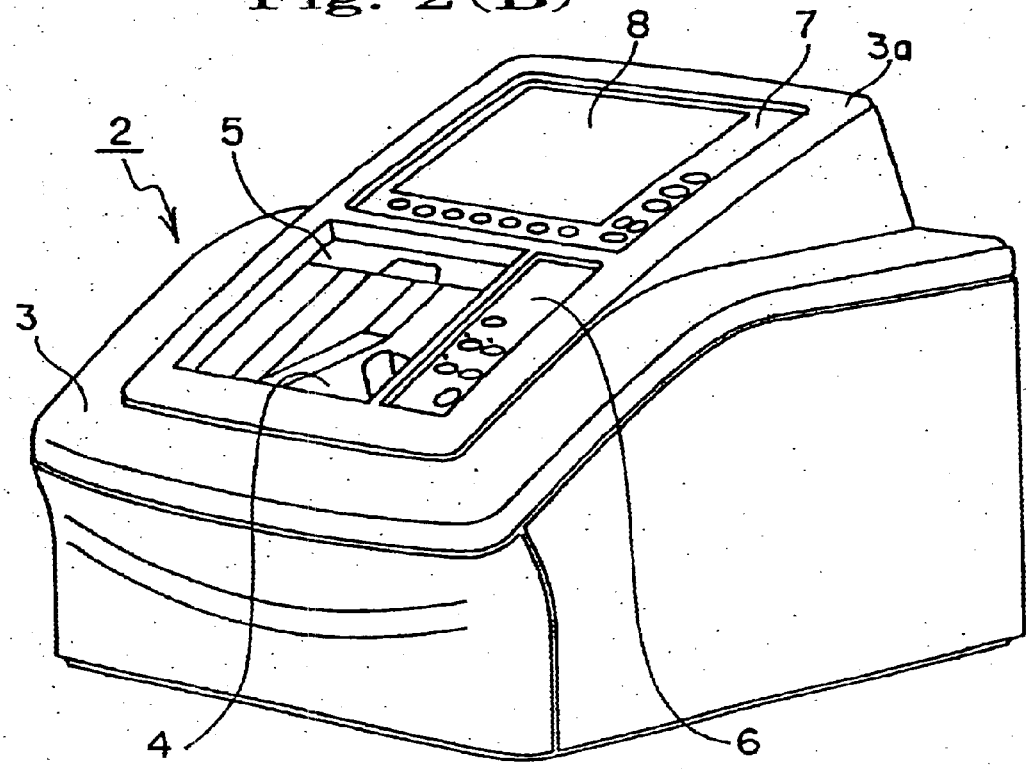
Figure 3:
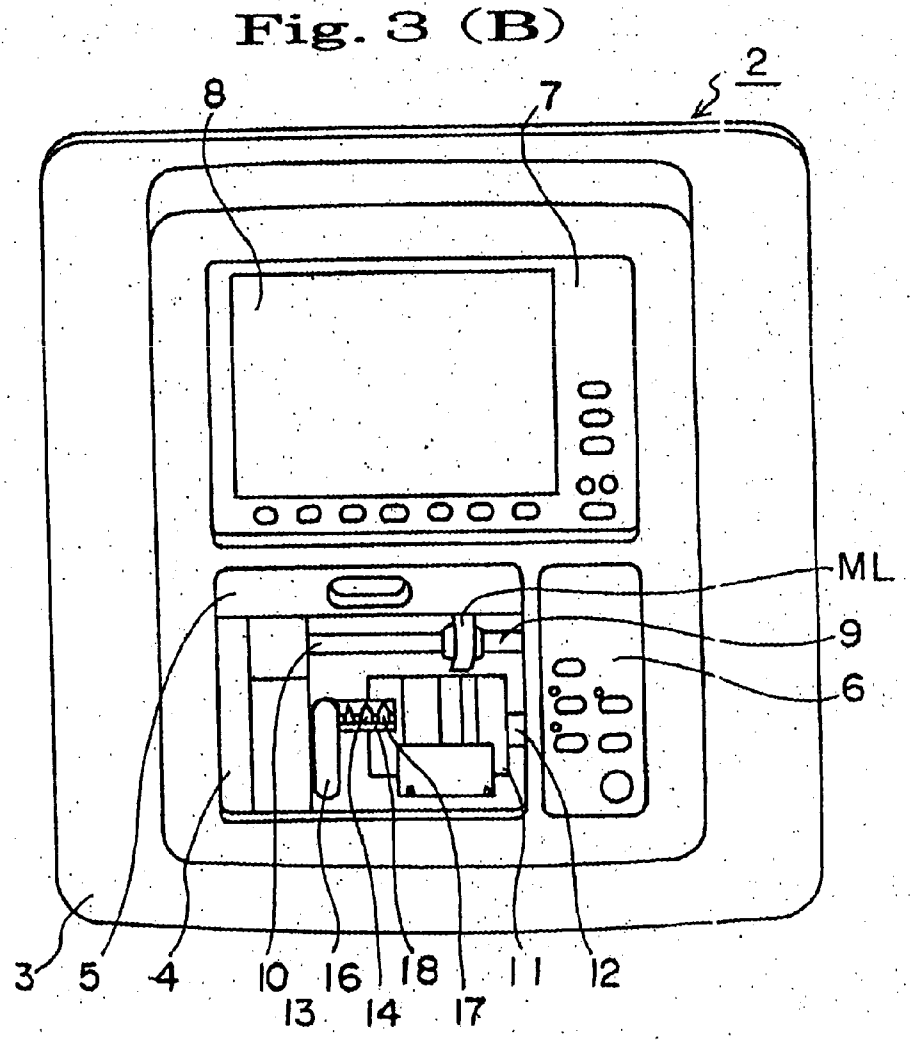
FIGS. 3A and 3B show the lens grinding apparatuses according to the embodiment of the present invention.
Figure 3:
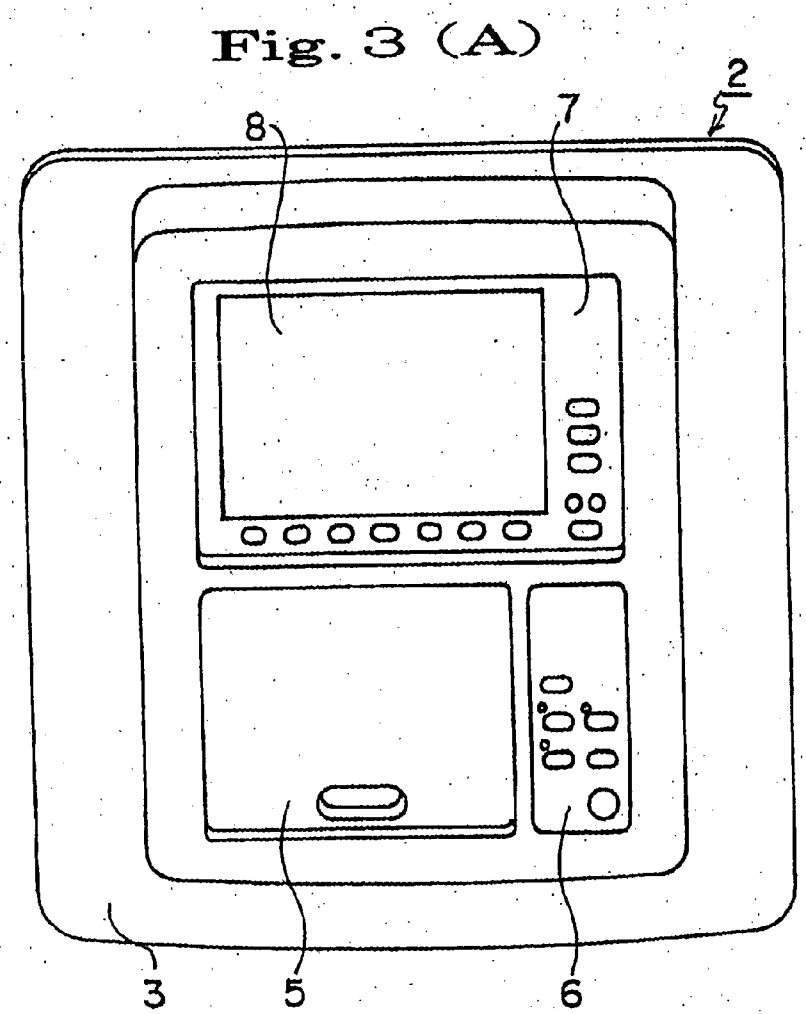

In FIG. 1, reference numeral 1 denotes a frame shape measuring apparatus (lens shape data measuring apparatus), which reads out lens shape information (θi, ρi) as lens shape data from a lens frame shape of an eyeglass frame F, a template thereof, a lens model, or the like. Reference numeral 2 denotes a lens grinding apparatus (lens grinder), which grinds a natural lens or the like to make an eyeglass lens ML based on the lens shape data of the eyeglass frame inputted by transmission from the frame shape measuring apparatus or the like. Note that a publicly known frame shape measuring apparatus can be used as the frame shape measuring apparatus 1, and explanation of a detailed constitution thereof, data measuring method, or the like will be omitted.

<Lens Grinding Apparatus 2>

As shown in FIGS. 1 to 3B, on an upper portion of the lens grinding apparatus 2, an upper surface (slant surface) 3*a* slanted downward to the front side of an apparatus unit 3 is provided, and a processing chamber 4 opening at the front side portion (lower portion) of the upper surface 3*a* is formed. The processing chamber 4 is opened and closed with a cover 5 which is attached to the apparatus unit 3 so as to be obliquely slid up and down.

On the upper surface 3*a* of the apparatus unit 3, provided are an operation panel 6 positioned on a side of the processing chamber 4; an operation panel 7 positioned behind an upper opening of the processing chamber 4; and a liquid crystal display device 8 positioned behind a lower portion of the operation panel 7, displaying an operation state the operation panels 6 and 7.

Further, as shown in FIGS. 5A to 7, a grinding portion 10 having the processing chamber 4 is provided in the apparatus unit 3. The processing chamber 4 is formed within a surrounding wall 11 fixed to the grinding portion 10.

Figure 6:
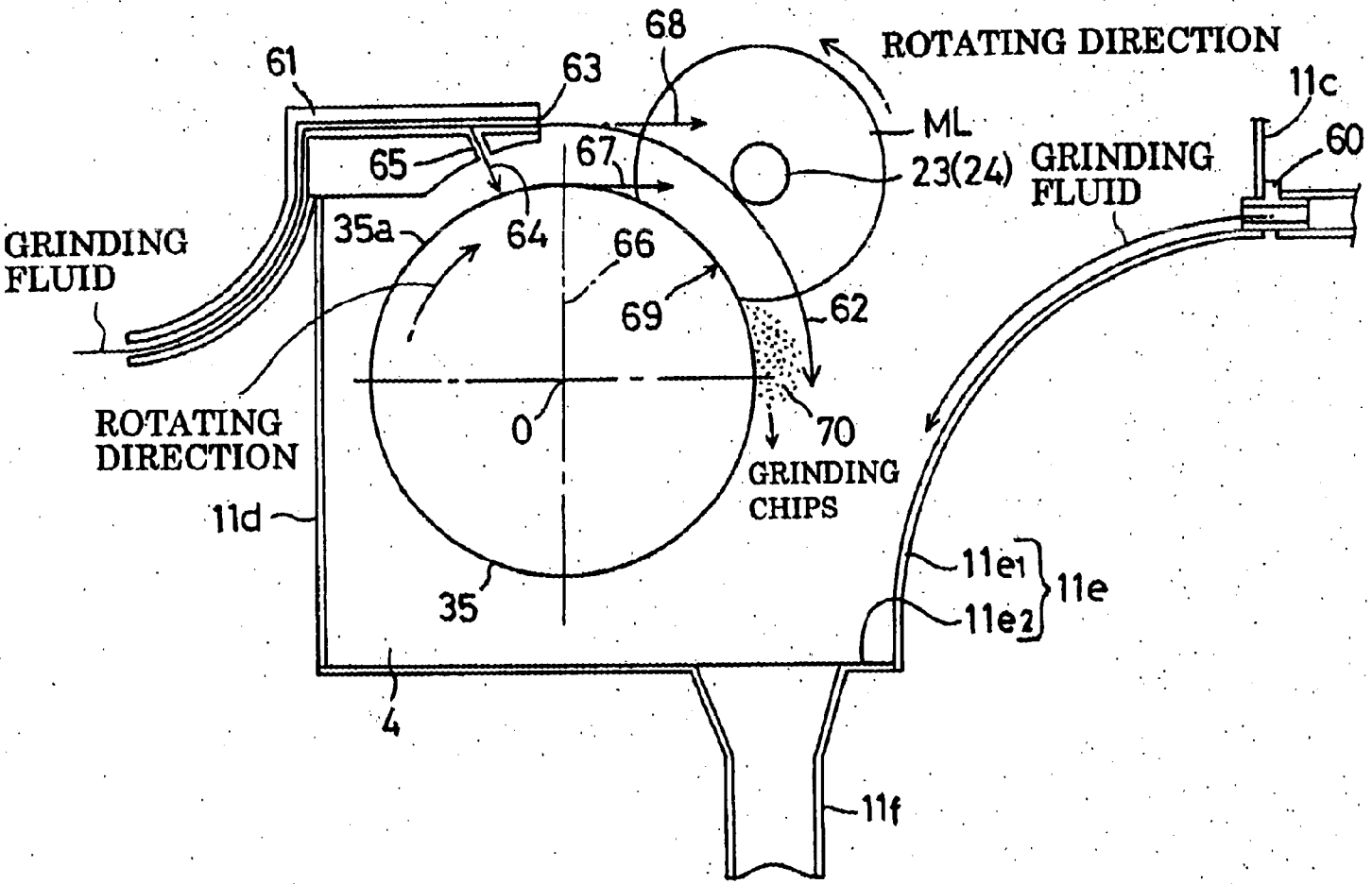
FIG. 6 is a schematic sectional view taken along the line A—A of FIG. 5A.
Figure 7:
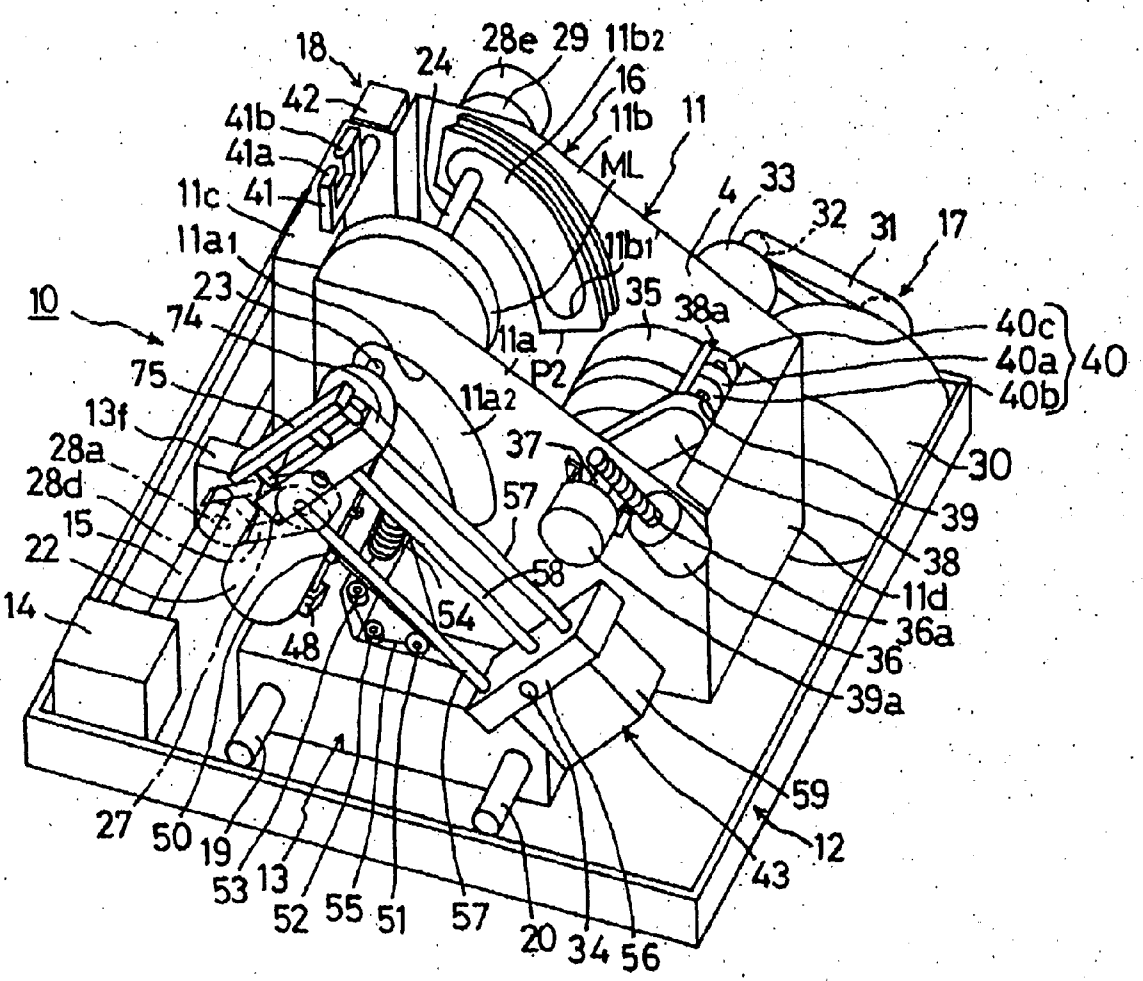
FIG. 7 is a perspective view of a drive system including the constitution in FIG. 5A.

The surrounding wall 11 has left and right side walls 11*a* and 11*b*, a rear wall 11*c*, a front wall 11*d*, and a bottom wall 11*e*, as shown in FIGS. 5A and 7. In addition, on the side walls 11*a* and 11*b*, arc-shaped guide slits 11*a*1 and 11*b*1 are formed, respectively (see FIG. 5A or FIG. 7). As shown in FIGS. 5A and 6, the bottom wall 11*e* has: an arc-shaped bottom wall (slanted bottom wall) 11*e*1 extending downward in an arc shape from the rear wall 11*c* to the front side; and a lower bottom wall 11*e*2 extending from the front lower end of the arc-shaped bottom wall 11*e*1 to the front wall 11*d*. The lower bottom wall 11*e*2 is provided with a drain 11*f* in the vicinity of the arc-shaped bottom wall 11*e*1, and the drain 11*f* extends to a wastewater tank (not shown) in the lower portion.

(Cover 5)

The cover 5 is composed of one colorless transparent or colored transparent (for example, gray colored transparent) panel made of glass or resin and is slid forward and backward in the apparatus unit 3.

(Operation Panel 6)

Figure 4:
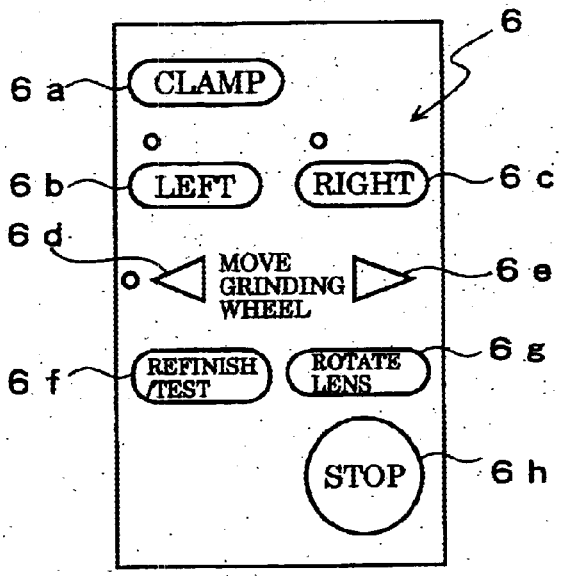
FIGS. 4A and 4B show the lens grinding apparatuses according to the embodiment of the present invention.
Figure 4:
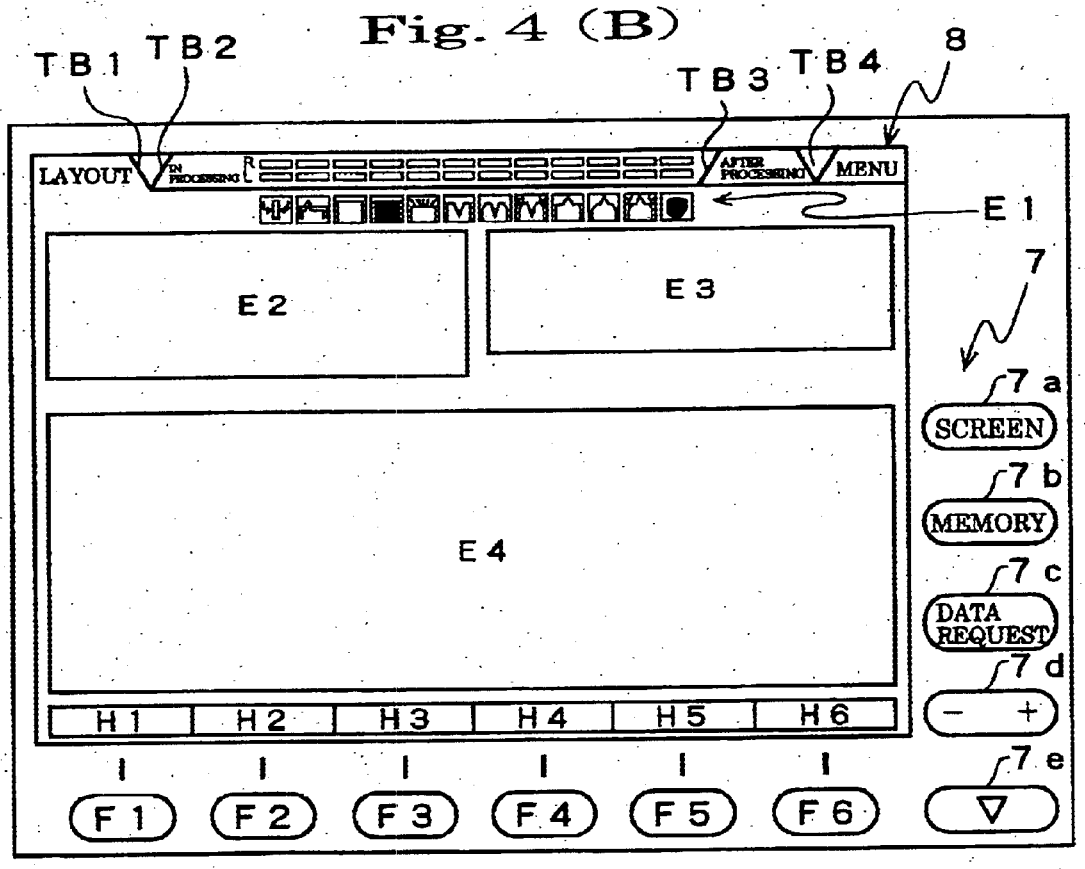
Figure 5:
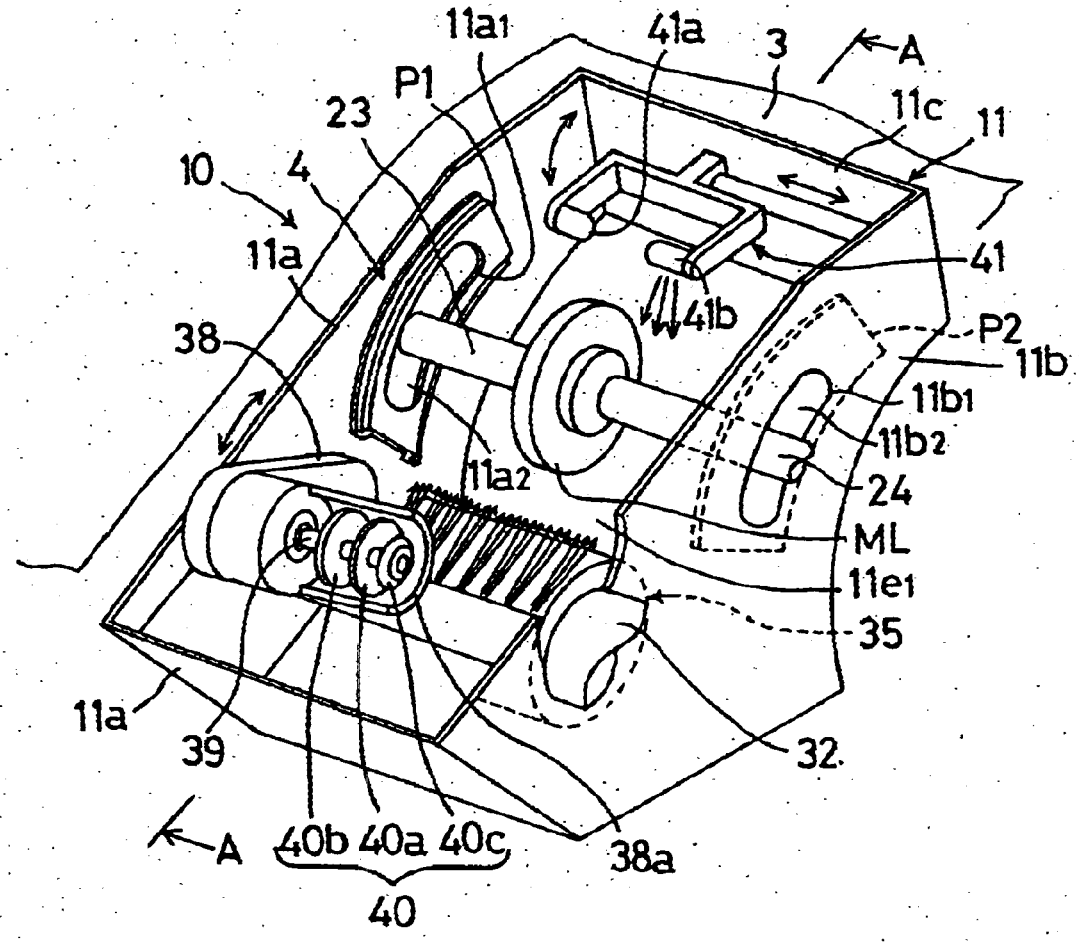
FIGS. 5A and 5B show the lens grinding apparatuses according to the embodiment of the present invention.
Figure 5:
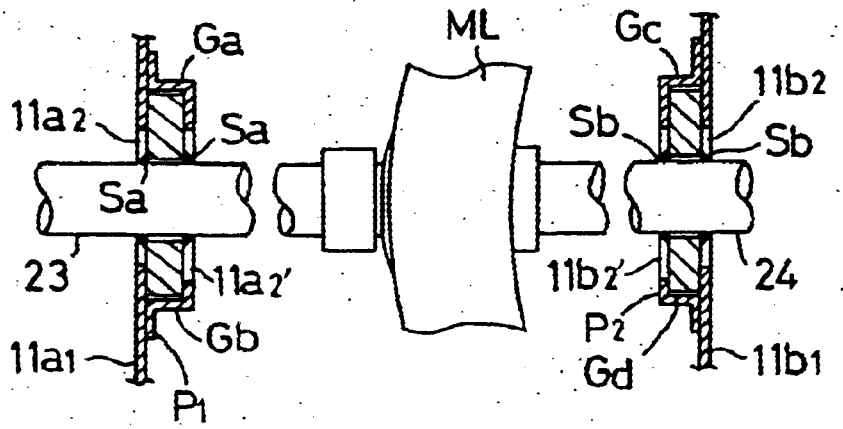

As shown in FIG. 4A, the operation panel 6 is provided with a "clamp" switch 6*a* for clamping the eyeglass lens ML with a pair of lens shafts 23 and 24 to be described later; a "left" switch 6*b* and a "right" switch 6*c* for specifying the processing of the eyeglass lens ML for a right eye or a left eye or switching displaying thereof; "move grinding wheel" switches 6*d* and 6*e* for moving the grinding wheel in the right and left directions; a "refinish/test" switch 6*f* for refinishing in the case that a finish grinding of the eyeglass lens ML is insufficient or for a tentative grinding in the case that the grind is tentatively performed; a "rotate lens" switch 6*g* for a lens rotation mode; and a "stop" switch 6*h* for a stop mode.

This is for reducing the burden of work of an operator by disposing such switches necessary for the actual lens processing near the processing chamber 4.

(Operation Panel 7)

The operation panel 7, as shown in FIG. 4B, has: a "screen" switch 7*a* for switching a displaying state of the liquid crystal display device 8; a "memory" switch 7*b* for memorizing settings or the like concerning the grinding displayed on the liquid crystal display device 8; a "data request" switch 7*c* for fetching out the lens shape information (θi, ρi); a seesaw type "−+" switch for use in a numerical correction or the like (or "−" and "+" switches may be separately provided); and a "▽" switch 7*e* for moving a cursor pointer, which are located at the side of the liquid crystal display device 8. Moreover, function keys F1 to F6 are arranged below the liquid crystal display device 8.

The function keys F1 to F6 are used in case of setting with regard to the grinding of the eyeglass lens ML, as well as are used in response or selection for messages displayed on the liquid crystal display device 8 during the grinding process.

As for the function keys F1 to F6, in the setting with regard to the grinding (layout screen), the function key F1 is used for inputting a kind of lens; the function key F2 for inputting a grinding course; the function key F3 for inputting a lens material; the function key F4 for inputting a kind of frame; the function key F5 for inputting a kind of chamfering; and the function key F6 for inputting a specular working.

As the kinds of lens inputted with the function key F1, "mono-focal", "ophthalmic formula", "progressive", "bifocal", "cataract", "tsubokuri" (concave-like lens) and the like are cited. The "cataract" generally means a plus lens having a high diopter in the eyeglass world, and the "tubokuri" means a minus lens having a high diopter.

As the grinding course inputted with the function key F2, "auto", "test", "monitor", "frame change", and the like are numerated.

As the kinds of material of the lens to be ground, which are inputted with the function key F3, "plastic", "high index", "glass", "polycarbonate", "acrylic", and the like are numerated. As the kinds of eyeglass frame F inputted with the function key F4, "metal", "cell", "optyl", "flat", "grooving (thin)", "grooving (middle)", "grooving (thick)", and the like are numerated. Each "grooving" indicates a V-groove that is a kind of the V-groove processing.

As the kinds of chamfering inputted with the function key F5, "none", "small", "middle", "large", "special", and the like are numerated.

As the kinds of specular working inputted with the function key F6, "non-execution", "execution", "mirror plane of chamfer portion", and the like are numerated.

Note that modes, types, and an order of the above-described unction keys F1 to F6 are not particularly limited. Moreover, for selection of tabs TB1 to TB4 to be described later, function keys for selecting "layout", "in processing ", "after processing", "menu" and the like may be further provided, an the number of keys is not limited.

(Liquid Crystal Display Device 8)

In the liquid crystal display device 8, display is changed by a "layout" tab TB1, an "in processing" tab TB2, an "after processing" tab TB3, and a "menu" TB4. The liquid crystal display device 8 has function display sections H1 to H6 corresponding to the function keys F1 to F6 at the lower portion thereof. Note that colors of the tabs TB1 to TB4 are different from each other. In changing the selection of the tabs TB1 to TB4, the color of the background of the display screen other than areas E1 to E4, which will be described later, is changed to the same color as that of the selected tab.

For example, the "layout" tab TB1 and the entire display screen (background) attached with the tab TB1 are displayed in blue; the "in processing" tab TB2 and the entire display screen (background) attached with the tab TB2 in green; the "after processing" tab TB3 and the entire display screen (background) attached with the tab TB3 in red; and the "menu" tab TB4 and the entire display screen (background) attached with the tab TB4 in yellow.

In such a manner, since each of the tabs TB1 to TB4, which are classified for each operation depending on color, and the background of the display screen therewith are displayed in the same color, the operator can easily recognize or confirm the current operation that is being performed.

In the function display sections H1 to H6, necessary objects are properly displayed. In a non-display state, images, numerical values, conditions, or the like different from displays corresponding to the functions of the function keys F1 to F6 can be displayed. Moreover, when each of the function keys F1 to F6 is being operated, display such as a mode display may be changed for each click of the function key F1, for example, during the operation of the function key F1. For example, a list of modes corresponding to the function key F1 may be displayed (pop-up display), whereby the selecting operability can be improved. The list in the pop-up display may be shown with characters, diagrams, icons, or the like.

While the "layout" tab TB1, the "in processing" tab TB2, or the "after processing" tab TB3 are being selected, the display screen is displayed to be sectioned into an icon display area E1, a message display area E2, a numerical value display area E3, and a state display area E4. While the "menu" tab TB4 is being selected, the display screen is displayed as one menu display area as a whole. Note that, while the "layout" tab TB1 is being selected, the "in processing" tab TB2 and the "after processing" tab TB3 are not displayed, and the tab TB2 and the tab TB3 may be displayed at the time when the layout setting is completed, Since the layout setting by use of the above described liquid crystal display device 8 is similar to that in Japanese Patent Application Nos. 2000-287040 and 2000-290864, detailed description thereof will be omitted.

<Grinding Portion 10>

Figure 8:
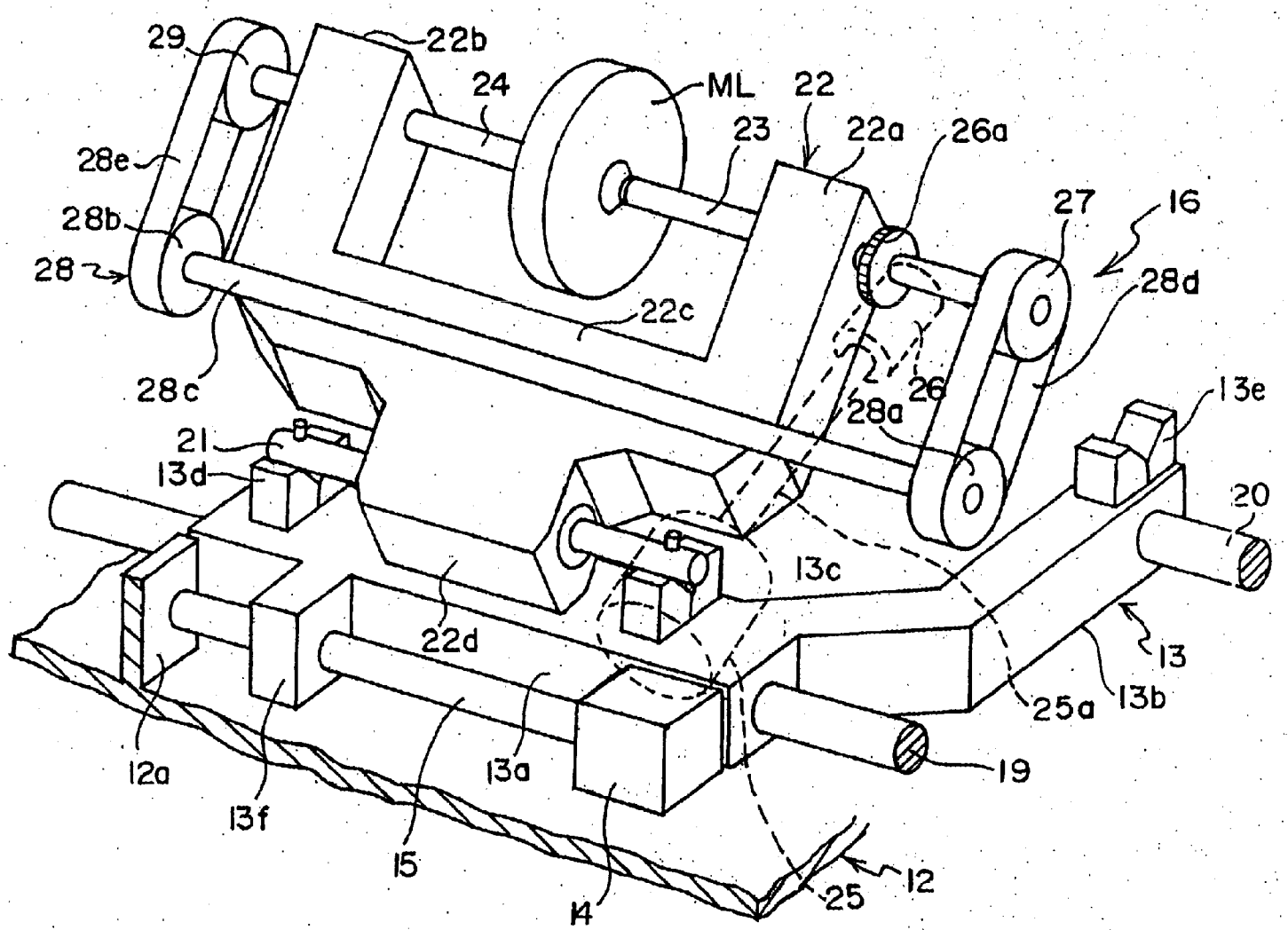
FIG. 8 is a perspective view from behind of a carriage for holding lens shafts, a base, and the like in FIG. 7.

As shown in FIGS. 7 and 8, the grinding portion 10 comprises: a tray 12 fixed to the apparatus unit 3; a base 13 disposed on the tray 12; a base drive motor 14 fixed to the tray 12; and a screw shaft 15, which has a tip rotatably supported by a support portion 12*a* and is rotated with an output shaft (not shown) of the base drive motor 14. The support portion 12*a* is raised from the tray 12 (see FIG. 8). The grinding portion 10 further comprises: a rotation drive system 16 for the eyeglass lens ML; a grinding system 17 for the eyeglass lens ML; and an edge thickness measuring system 18 for the eyeglass lens ML, as a driving system.

(Base 13)

The base 13 is formed by a rear support portion 13*a* extending along a rear edge of the tray 12 in the transverse direction and a side support portion 13*b* extending from a left end of the rear support portion 13*a* to the front side, and the base 13, so as to approximately have a V-shape. Shaft support members 13*c* and 13*d*, which are V-shaped blocks, are respectively fixed on the right and left end portions of the rear support portion 13*a*, and a shaft support member 13*e*, which is a V-shaped block, is fixed on the side support portion 13*b*.

In the apparatus unit 3, a pair of parallel guide bars 19 and 20 extending in the transverse direction are disposed in parallel on the front and rear sides, respectively. The left and right ends of the parallel guide bars 19 and 20 are attached to the left and right portions in the apparatus unit 3. The rear support member 13*b* of the base 13 is pivotally supported by the parallel guide bars 19 and 20 so as to advance and retract right and left in an axis direction of the guide bars 19 and 20.

Moreover, both ends of a carriage swing shaft 21 extending in the transverse direction are disposed on V-grooves on the shaft support members 13*c* and 13*d*. Referential numeral 22 denotes a carriage attached to the carriage swing shaft 21. The carriage 22 is composed of arm portions 22*a* and 22*b* for attachment of shafts, a connecting portion 22*c*, and a support projecting portion 22*d* to be formed in a bifurcate shape The arm portions 22*a* and 22*b* are positioned on the left and right sides with an interval therebetween and extended forward and rearward. The connecting portion 22*c* is extended in the transverse direction and connects the rear ends of the arm portions 22*a* and 22*b*. The support projecting portion 22*d* is provided in the center of the connecting portion. 22*c* in the transverse direction to project rearward. The arm portions 22*a* and 22*b* and the connecting portion 22*c* form a horseshoe. The surrounding wall 11 defining the processing chamber 4 is disposed between the arm portions 22*a* and 22*b*.

The carriage swing shaft 21 penetrates the support projecting portion 22*d* and is held by the support projecting portion 22*d*, while the carriage swing shaft 21 freely rotates with respect to the shaft support members 13*c* and 13*d*. Accordingly, the front end portion of the carriage 22 can swing around the carriage swing shaft 21 up and down. Note that the carriage swing shaft 21 may be fixed to the shaft support portions 13*c* and 13*d*, and the support projecting portion 22*d* may be held by the carriage swing shaft 21 so as to swing with respect to the carriage swing shaft 21 and so as not to move in the axis direction thereof.

The carriage 22 is provided with a pair of the lens shafts (lens rotation shafts) 23 and 24, which extend in the transverse direction and sandwich the eyeglass lens (unprocessed circular eyeglass lens, that is, circular raw lens) ML on the same axis. The lens shaft 23 penetrates the tip of the arm portion 22*a* in the transverse direction, and is held thereon so as to rotate around the axis and so as not to move in the axis direction. The lens shaft 24 penetrates the tip of the arm portion 22*b* in the transverse direction, and is held thereon so as to rotate around the axis and adjust the movement in the axis direction. Since a well-known structure is employed as such a structure, detailed description will be omitted.

The drive motor 14 is operated to drive the screw shaft 15 rotatively, whereby the guide member 13*f* is advanced and retract in the axis direction of the screw shaft 15, and then the base 13 is moved along with the guide member 13*f*. At this time, the base 13 is guided by the pair of the parallel guide bars 19 and 20 to be displaced in the axis direction thereof

[Carriage 22]

The guide slits 11*a*1 and 11*b*1 of the above-described surrounding wall 11 are formed in arc shapes around the carriage swing shaft 21. The opposed ends to each other of the lens shafts 23 and 24, which are held by the carriage 22, are inserted into the guide slits 11*a*1 and 11*b*1. Accordingly, the opposed ends of the lens shafts 23 and 24 are projected into the processing chamber 4 surrounded by the surrounding wall 11.

As shown in FIG. 5A, an arc-shaped guide plate P1 having a hat-shaped section is attached on the inner wall surface of the side wall 11*a*. As shown in FIG.7, an arc-shaped guide plate P2 hating a hat-shaped section is attached on the inner wall surface of the side wall 11*b*. In the guide plates P1 and P2, guide slits 11*a*1' and 11*b*1' extending in an arc shape are formed so as to correspond to the guide slits 11*a*1 and 11*b*1, respectively. A cover plate 11*a*2 for closing the guide slits 11*a*1 and 11*a*1' is disposed between the side wall 11*a* and the guide plate P1 so as to move forward and rearward and up and down. A cover plate 11*b*2 for closing the guide slits 11*b*1 and 11*b*1' is disposed between the side wall 11*b* and the guide plate P2 so as to move forward and rearward and up and down. The cover plates 11*a*2 and 11*b*2 are attached to the lens shafts 23 and 24, respectively.

In addition, the guide plate P1, arc-shaped guide rails Ga and Gb are provided, which are positioned above and below the guide slits 11*a*1 and 11*a*1' along the upper and lower edges of the guide slits 11*a*1 and 11*a*1'. The guide plate P2 is provided with arc-shaped guide rails Gc and Gd respectively positioning above and below the guide slits 11*b*1 and 11*b*1' to follow the upper and lower edges of the guide slits 11*b*1 and 11*b*1'.

The cover plate 11*a*2 can be guided in the guide rails Ga and Gb at the upper and lower edges thereof to move up and down while drawing an arc. The cover plate 11*b*2 can be guided in the guide rails Gc and Gd at the upper and lower edges thereof to move up and down while drawing an arc.

The lens shaft 28 of the carriage 22 slidably penetrates the arc-shaped cover plate 11*a*2, thus facilitating assemblies of the lens shaft 23, the side wall 11*a*, the guide plate P1, and the cover plate 11*a*2. The lens shaft 24 of the carriage 22 slidably penetrates the arc-shaped cover plate 11*b*2, thus facilitating assemblies of the lens shaft 24, the side wall 11*b*, the guide plate P2, and the cover plate 11*b*2.

Moreover, a space between the cover plate 11*a*2 and the lens shaft 23 is sealed by seal members Sa and Sa, and the cover plate 11*a*2 is held by the lens shaft 23 via the seal members Sa and Sa. A space between the cover plate 11*b*2 and the lens shaft 24 is sealed by seal members Sb and Sb, and the cover plate 11*b*2 is held by the lens shaft 24 via the seal members Sb and Sb so as to relatively move in the axis direction. Accordingly, when the lens shafts 23 and 24 rotate along the guide slits 11*a*1 and 11*b*1 while drawing an arc, the cover plates 11*a*2 and 11*b*2 can also move up and down together with the lens shafts 23 and 24, respectively.

The side wall 11*a* and the guide plate P1 are close to the arc-shaped cover plate 11*a*2 so as to contact thereto tightly, and the side wall 11*b* and the guide plate P2 are close to the arc-shaped cover plate 11*b*2 so as to cling thereto tightly.

Each of the guide plates P1 and P2 in the processing chamber 4 is provided to extend to the vicinities of the rear wall 11*c* and the lower bottom wall 11*e*2 and is designed to have the upper end cut on the side of a feeler 41 and the lower end cut in the upper vicinity of a grinding wheel 36, whereby the upper and lower ends of the guide plates P1 and P2 are opened within the processing chamber 4. Accordingly, the grinding fluid is flown along the inner surfaces of the side walls 11*a* and 11*b*, so that the grinding fluid does not stay between the side wall 11*a* and the guide plate P1 and between the side wall 11*b* and the guide plate P2.

When the carriage 22 is swung up and down around the carriage swing shaft 21 and the lens shafts 23 and 24 are moved up and down along the guide slits 11*a*1 and 11*b*1, the cover plates 11*a*2 and 11*b*2 are moved up and down together with the lens shafts 23 and 24. Accordingly, the guide slits 11*a*1 and 11*b*1 are always closed by the cover plates 11*a*2 and 11*b*2, and then the grinding fluid or the like within the surrounding wall 11 does not leak to the outside of the surrounding wall 11. Note that the eyeglass lens ML is close to or apart from the grinding wheel with the upward and downward movement of the lens shafts 23 and 24.

At the time of loading of the raw lens of the eyeglass lens ML or the like to the lens shafts 23 and 24 and unloading thereof after the grinding, the carriage 22 is positioned in the center of the swinging in the vertical direction such that the lens shafts 23 and 24 are positioned in the middle of the guide slits 11*a*1 and 11*b*1, respectively. At the time of measuring the edge thickness and the grinding, the carriage 22 is controlled and swung upward and downward to be slant in accordance with a grinding amount of the eyeglass lens ML.

(Rotation Drive System 16 for Lens Shafts 23 and 24)

The rotation drive system 16 for lens shafts 23 and 24 has a lens shaft drive motor 25 fixed to the carriage 22 by not-shown fixing means; a power transmission shaft (drive shaft) 25*a*, which is rotatably held by the carriage 22 and is linked with an output shaft of the lens shaft drive motor 25; a drive gear 26 provided on the tip of the power transmission shaft 25*a*; and a driven gear 26*a* geared with the drive gear 26 and attached to one lens shaft 23. In FIG. 8, as the drive gear 26, a worm gear is employed, and as the driven gear 26*a*, a worm wheel is employed. Note that, as the drive gear 26 and the driven gear 26*a*, a bevel gear can be employed.

The rotation drive system 16 further comprises a pulley 27 fixed to the outer end (opposite end to the lens shaft 24) of one lens shaft 23; a power transmission mechanism 28 provided for the carriage 22; and a pulley 29 rotatably held on the outer end (opposite end to the lens shaft 28) of the other lens shaft 24. The pulley 29 is provided so as to relatively move against the lens shaft 24 in the axis direction thereof. Moreover, when the lens shaft 24 is adjusted to move in the axis direction, the movement of the pulley 29 is controlled by a not-shown movement control member or the like provided with the carriage 22 such that the position of the pulley 29 is not changed in the axis direction.

The power transmission mechanism 28 has transmission pulleys 28*a* and 28*b*; and a transmission shaft (power transmission shaft) 28*c* having the transmission pulleys 28*a* and 28*b* fixed on both ends thereof. The transmission shaft 28*c* is disposed parallel to the lens shafts 23 and 24 and rotatably held by the carriage 22 with a not-shown bearing.

The power transmission mechanism 28 farther comprises a driving side belt 28*d* bridged between the pulley 27 and the transmission pulley 28*a*; and a driven side belt 28*e* bridged between the pulley 29 and the transmission pulley 28*b*.

When the lens drive motor 25 is operated to rotate the power transmission shaft 25*a*, the rotation of the power transmission shaft 25*a* is transmitted via the drive gear 26 and the driven gear 26*a* to the lens shaft 23, so that the lens shaft 23 and the pulley 27 are rotatively driven together. Meanwhile, the rotation of the pulley 27 is transmitted via the drive side belt 28*d*, the transmission pulley 28*a*, the transmission shaft 28*c*, the transmission pulley 28*b*, and the driven side belt 28*e* to the pulley 29, and then the pulley 29 and the lens shaft 24 are rotatively driven integrally. At this time, the lens shaft 24 and the lens shaft 23 are integrally rotated in synchronization with each other.

(Grinding System 17)

The grinding system 17 includes a grinding wheel drive motor 30 fixed to the tray 12; a transmission shaft 32 to which drive of the grinding wheel drive motor 30 is transmitted via a belt 31; a grinding wheel shaft 33 to which rotation of the transmission shaft 32 is transmitted; and the grinding wheel 35 fixed to the grinding wheel shaft 33. The grinding wheel 35 includes a rough grinding wheel, a grinding wheel for a V-groove, a finish grinding wheel, or the like, of which reference numerals are omitted. The rough grinding wheel, the grinding wheel for the V-groove and the finish grinding wheel are disposed side by side in the axis direction.

The grinding system 17 further includes a swing arm drive motor 36 fixed to the apparatus unit 3; a worm gear 36*a* fixed to the output shaft of the swing arm drive motor 36; a tubular shaft-shaped worm 37 rotatably held by the surrounding wall 11; a hollow swing arm 38 integrally fixed to the worm 37; a rotation shaft 89 having one end rotatably held by a free end of the swing arm 38 and projecting from the free end to the right direction in FIG. 5A; and a grinding wheel 40 for grooving fixed to the rotation shaft 39.

The grinding system 17 further includes a drive motor 39*a* attached to the surrounding wall 11 and of which a not-shown output shaft of the drive motor 39*a* is inserted into the tubular worm shaft 37; and a power transmission mechanism disposed within the swing arm 38 to transmit rotation of the output shaft of the drive motor 39*a* to the rotation shaft 39, As shown in FIGS. 5A and 7, the grinding wheel 40 for grooving includes chamfering grinding wheels 40*a* and 40*b* for processing a chamfer on the periphery of the eyeglass lens ML; and a grooving cutter 40*c* attached to the rotation shaft 39 adjacent to the chamfering grinding wheel 40*a*. Moreover, an arc-shaped cover 38*a* extending to a right direction in FIG. 5A is attached on the swing arm 38. The arc-shaped cover 38*a* covers lower portions of the chamfering grinding wheels 40*a* and 40*b* and the grooving cutter 40*c*.

(Grinding Fluid Supply Structure)

As described above, the bottom wall 11*e* of the surrounding wall 11 defining the processing chamber 4 includes the arc-shaped bottom wall 11*e*1 and the lower bottom wall 11*e*2. The arc-shaped bottom wall 11*e*1 is formed in the arc shape around the carriage swing shaft 21.

Furthermore, the surrounding wall 11 includes the rear wall 11*c* and the front wall 11*d* as described above. A grinding fluid discharge nozzle 60 open forward is attached to the center of the lower end of the rear wall 11 in the transverse direction as grinding fluid supply means. A grinding fluid discharge nozzle 61 projecting rearward is attached to the front wall 11*d* as grinding fluid supply means. Note that the grinding fluid discharge nozzle 60 can be widely provided such that the grinding fluid is discharged from the entire width of the rear wall 11*c*. In such a case, if grinding chips or the like are scattered on the any places of arc-shaped bottom wall 11*e*1, such grinding chips are swept downward by the grinding fluid, thus preventing the grinding chips from adhering to the arc-shaped bottom wall 11*e*1.

The grinding fluid discharge nozzle 61 is integrally provided with a first grinding fluid outlet (first grinding fluid supply means) 63 for discharging and supplying the grinding fluid 62 so that the grinding fluid 62 covers an upper portion and portions on the lens shafts 23 and 24 sides of the grinding surface 35*a* of the grinding wheel 35; and a second grinding fluid outlet (second grinding fluid supply means) 65 for supplying the grinding fluid 64 to the grinding surface 35*a* of the grinding wheel 35 in the normal direction thereof. The grinding fluid outlets 68 and 65 are diverged from a grinding fluid supply path 61*a*.

Note that the grinding fluid 62 is discharged rearward in an arc shape from the grinding fluid outlet 63 and is passed slightly below the lens shafts 23 and 24 to be flown downward. Here, a plumb line passing the rotational center O of the grinding wheel 35 is indicated by the reference numeral 66, and a tangent line passing the intersection point of the plumb lime 66 and the grinding surface 35*a* is indicated by a reference numeral 67. The grinding fluid 62 is discharged in the approximately same direction as the tangent line 67, in other words, is discharged from the grinding fluid outlet 63 rearward as well as in the parallel direction to the tangent line 67 as indicated by the arrow 68.

Moreover, a width of the grinding fluid outlet 65 is formed to be a width in the transverse direction approximately equal to or larger than the width in the transverse direction of the grinding wheel 36. Therefore, the grinding fluid can be sufficiently supplied to the grinding surface (circumferential surface) 35*a* of the grinding wheel 35.

Furthermore, a width of the grinding fluid outlet 63 is formed to be a width in the transverse direction larger than that of the grinding fluid outlet 65. In addition, the both right and left ends of the grinding fluid outlet 63 are projected further than those of the grinding fluid outlet 65.

Since the width of the grinding fluid outlet 63 in the transverse direction is formed larger than that of the grinding fluid outlet 65 and the grinding fluid 62 is discharged with a slight space from the grinding surface 35*a*, the grinding fluid 62 discharged from the grinding fluid outlet 63 is allowed to cover the lens grinding portion (lens processing point) 69 side of the grinding surface 35*a* like a curtain with the space from the grinding surface 35.

In such a constitution, when the grinding fluid 64 is supplied from the grinding fluid outlet 65 to the grinding surface 35*a* in the normal direction thereof, the grinding fluid 64 can be sufficiently supplied to the lens processing point (lens grinding portion 69). The problem of such a method is that the grinding fluid supplied to the grinding surface 35*a* is scattered upward or rearward by the rotation of the grinding wheel 35, so that the grinding fluid is scattered to the upper portion or the rear portion of the processing chamber 4 to leak or dirty the rear wall 11, the lens shafts 23 and 24, or the like.

However, the grinding fluid 62 is discharged rearward from the grinding fluid outlet 63 in an approximately tangent direction, and covers the upper portion of the grinding surface 35*a* of the grinding wheel 35 and the lens processing point (lens grinding portion 69) like a curtain. At this time, since the width of the curtain-shaped grinding fluid 62 is made larger than that of the grinding fluid 64 discharged from the grinding fluid outlet 65, the grinding fluid 64 discharged from the grinding fluid outlet 65 is prevented from scattering rearward by the rotation of the grinding wheel 35. Accordingly, it can be prevented that the grinding fluid is scattered to the upper portion or the rear portion of the processing chamber 4 to leak or dirty the rear wall 11, the lens shafts 23 and 24, or the like.

Note that the grinding fluid 62, which is supplied in the tangent direction, in other words, which is discharged rearward from the grinding fluid outlet 63 in the approximately tangent direction, is slightly spaced from the grinding surface 35*a* of the grinding wheel 35 so as not to contact the grinding surface 35*a*. Accordingly, an effect of preventing splash of the grinding fluid 62 supplied in the tangent direction and an effect of preventing splash of the grinding fluid 64 supplied in the normal direction can be further enhanced.

Since the grinding fluid 62 and 64 are respectively supplied in the two directions, that is, in the tangent direction and the normal direction of the grinding wheel 35, the grinding fluid can be supplied all over the grinding surface 35*a* of the grinding wheel 35 and the eyeglass lens ML. Furthermore, one grinding fluid supply nozzle (grinding fluid supply apparatus) 61 is provided with the outlets 63 and 65, which supply the grinding fluid in the two direction, that is, the tangent direction and the normal direction of the grinding wheel 35. Accordingly, the grinding fluid supply nozzle (grinding fluid supply apparatus) 61 and the entire grinding apparatus can be made small and compact.

<Pressure Adjusting Mechanism 45>

In the vicinity of the carriage swing shaft 21 of the carriage 22, a pressure adjusting mechanism 45 is provided for adjusting a press-contact amount of the eyeglass lens ML to the grinding wheel 35.

Figure 9:
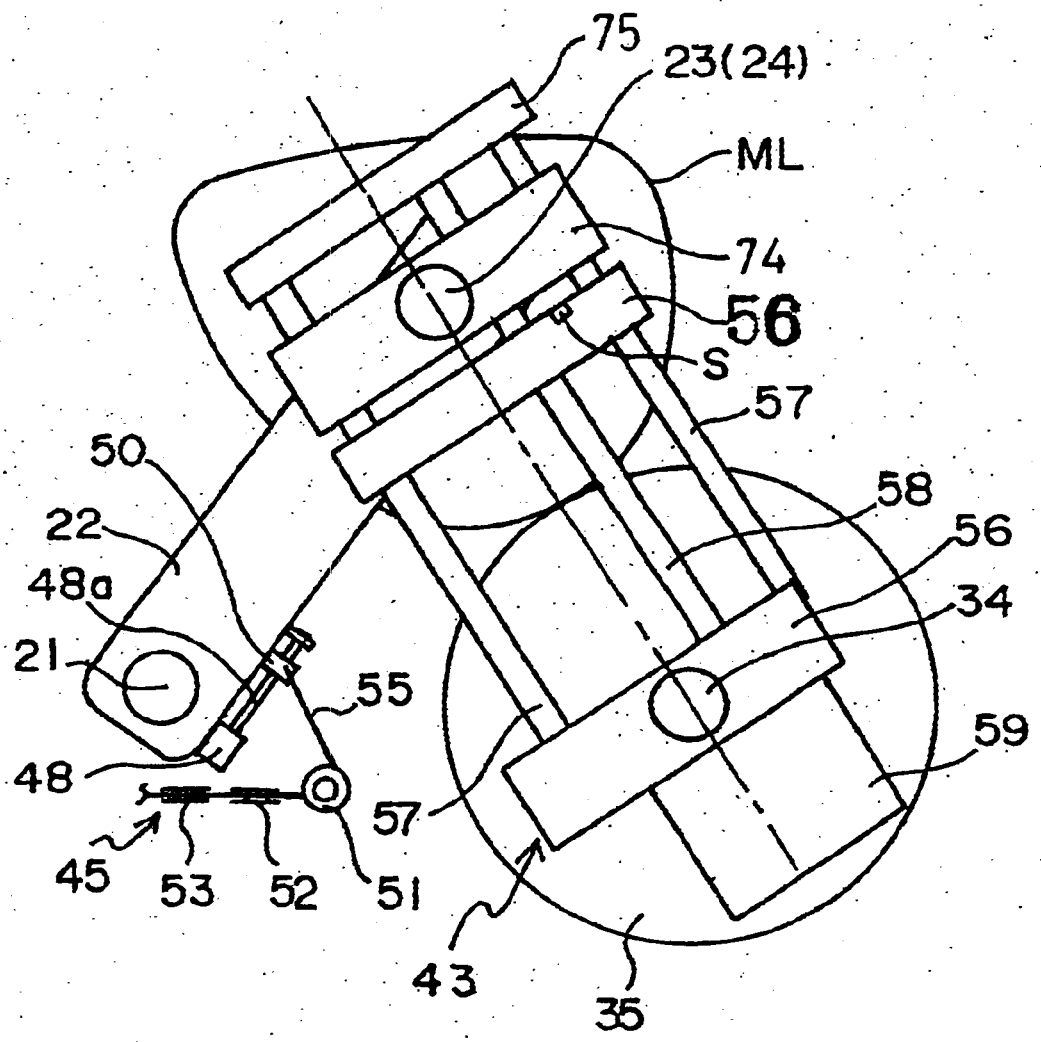
FIG. 9 is a side view showing a processing pressure adjusting mechanism and a shaft-to-shaft distance adjusting mechanism in FIG. 7.
Figure 10:
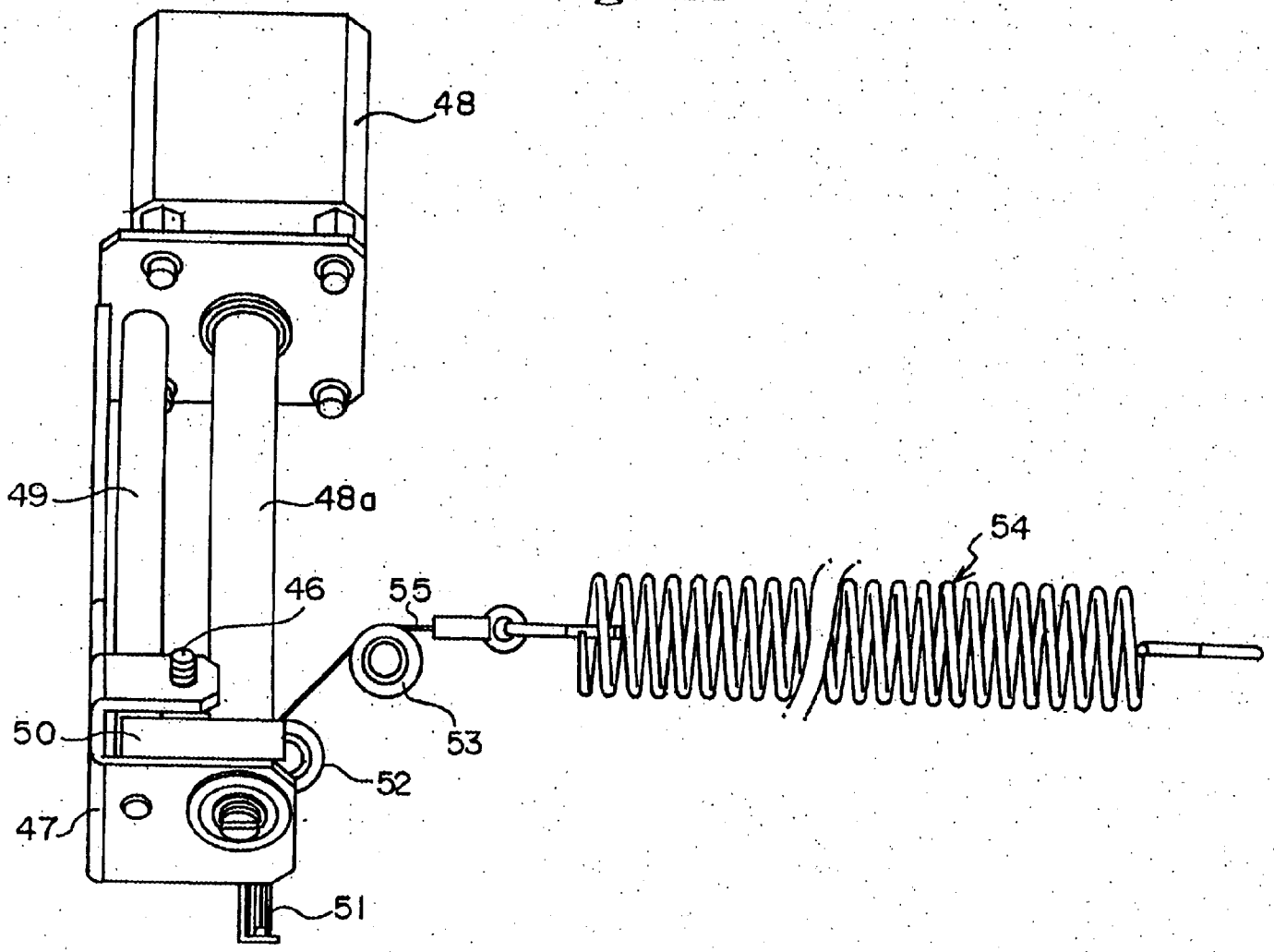
FIG. 10 is an explanatory view of the processing pressure adjusting mechanism in FIG. 9.

As shown in FIG. 10, the pressure adjusting mechanism 45 includes; a bracket 47 fixed to the carriage 22 with a screw 46; a mover displacement motor 48 fixed to the bracket 47; a screw shaft 48*a* rotating with a not-shown output shaft of the mover displacement motor 48; and a mover 50 geared with the screw shaft 48*a* (see FIG. 9). The tip of the screw shaft 48*a* is rotatably held by the bracket 47, and the mover 50 is guided by a guide rail 49 parallel to the screw shaft 48*a* in the axis direction.

Moreover, the pressure adjusting mechanism 45 further includes three pulleys 51, 52 and 53 rotatably held by the base 13; and a pull cord 55 having both ends held by the mover 50 and a spring 54. The pull cord 55 is changed the direction thereof by the pulleys 51, 52 and 53 so as to pull the mover 50 in the direction approximately orthogonal to the guide rail 49 with pull strength of the spring 54 The other end of the spring 54 is fixed to the base 13.

The pressure adjusting mechanism 45 utilizes that the distance between the mover 50 and the carriage swing shaft 21 is changed in accordance with a position of the mover 50 on the guide rail 49, and an energizing force caused by the pull strength of the spring 54 at the tip of the carriage 22, that is, an energizing pressure to the grinding wheel 35 by the eyeglass lens ML, which is sandwiched by the lens shafts 23 and 24, is thereby changed in accordance with the distance.

Note that the screw shaft 48*a* and the guide rail 49 are approximately orthogonal to the lens shaft 23 and the carriage swing shaft 21.

Accordingly, as for the contact state of the eyeglass lens ML with the grinding wheel 35, while the pull strength of the spring 54 is approximately constant, a contact force per unit area can be adjusted by changing the position of the mover 50 on the guide rail 49 in accordance with variation of the processing condition, such as a dislocation of the contact from the pressurized direction, a difference in the contact area in accordance with a variation in the shape of the eyeglass lens ML, and a difference in the edge thickness in accordance with the lens diopter As described above, since the carriage 22 is slant downward from the intermediate position in accordance with a grinding amount of the eyeglass lens ML, it is a matter of course the pressure adjusting mechanism 45 is positioned on a lower side of the slant carriage 22. Since the carriage 22 is slant, an operating force corresponding to the energizing force at the tip of the carriage 22 can be changed by using the mover 50 as a mere weight, even when the pulleys 51, 52, and 53, the spring 54, and the pull cord 55 are removed. Accordingly, abutment pressure by the eyeglass lens ML to the grinding wheel 35 can be adjusted in accordance with the position of the mover 50 on the guide rail 49.

<Shaft-to-Shaft Distance Adjusting Means 43>

As shown in FIG. 9, the distance between the lens shafts 23 and 24 and the grinding wheel shaft 33 is adjusted by shaft-to-shaft distance adjusting means (shaft-to-shaft distance adjusting mechanism) 43.

The shaft-to-shaft distance adjusting means 43 includes a rotation shaft 34 having an axis positioned on the same axis of the grinding wheel shaft 33 as shown in FIG. 9. The rotation shaft 34 is rotatably supported on the V-groove of the projecting support member 13*e* in FIG. 8.

The shaft-to-shaft distance adjusting means 43 includes a base board 56 held by the rotation shaft 34; a pair of parallel guide rails 57 and 57 attached to the base board 56 and obliquely extended upward from the upper surface thereof; a screw shaft (feed screw) 58 rotatably provided on the base board 56 to be parallel to the guide rails 57 and 57; a pulse motor 59 provided on the lower surface of the base board 56 for rotating the screw shaft 58; and a stage 73 screwed by the screw shaft 58 and held by the guide rails 57 and 57 to move up and down (omitted in FIG. 7 for convenience of illustrating other portions).

The shaft-to-shaft distance adjusting means 43 further includes a lens shaft holder 74 disposed above the stage 73 and held by the guide rails 57 and 57 so as to move up and down; a reinforcement 75 for holding the upper ends of the guide rails 57 and 57 and ratatably holding the upper end of the screw shaft 58. The lens shaft holder 74 is always rotatively energized downward by the spring force of the spring 54 of the pressure adjusting mechanism 45 to be pressed to the stage 73. Moreover, a sensor S for detecting an abutment of the lens shaft holder 74 is attached to the stage 73.

When the screw shaft 58 is normally or reversely rotated by a normal or reverse rotation of the pulse motor 59, the stage 73 is elevated or lowered along the guide rails 57 and 57 by the screw shaft 58, and then the lens shaft holder 74 is elevated or lowered integrally with the stage 73. Accordingly, the carriage 22 is swung around the carriage swing shaft 21.

(Edge Thickness Measuring System 18)

The edge thickness measuring system 18 includes a measuring element 41 having feelers 41*a* and 41*b* opposed and spaced with each other; a measuring unit (moving amount detecting means) 42 as a moving amount detecting sensor, which is positioned outside the surrounding wall 11 and attached to the apparatus unit 3; and a measurement shaft 42*a* provided parallel to the lens shafts 23 and 24 and held by the measuring unit 42 so as to advance or retract in the transverse direction (axis direction). The measurement shaft 42*a* is provided so as to rotate around the axis thereof and integrally provided with the measuring element 41.

The measurement shaft 42*a* is provided so as to rotate by 90 degree by means of a rotary solenoid RS to be described later. The rotary solenoid RS controls the rotation of the measurement shaft 42*a*, and then positions the measuring element 41 at any one of two positions, that is, a standing non-measurement position in FIG. 7 and a horizontal measurement position as shown in FIG. 5A.

In such a structure, the measuring unit 42 is designed to measure (detect) the moving amount of the measuring element 41 in the transverse direction when the measuring element 41 is in the horizontal position as shown in FIG. 5A. The edge thickness of the eyeglass lens ML can be obtained by calculation from measurement signals (moving amount detecting signals) from the measuring unit 42 and the position of the carriage 22 in the transverse direction based on the position where one feeler 41*a* abuts the front or rear surface of the eyeglass lens ML and the position of the other feeler 41*b* abuts the rear or front surface of the eyeglass lens ML.

Specifically, the pair of lens shafts 23 and 24 is controlled in rotation thereof at each angle θi based on the lens shape information (θi, ρi), and the shaft-to-shaft distance adjusting means 43 is controlled in motion thereof based on the lens shape information (θi, ρi), so that the feelers 41*a* and 41*b* are allowed to abut the front or rear surface of the eyeglass lens ML one by one, and then the feeler 41*a* or 41*b* is moved to the position of a radius vector ρi of the eyeglass lens ML for each angle θi. Coordinates of the contact position of the feelers 41*a* and 41*b* with the eyeglass lens ML is obtained corresponding to the lens shape information (θi, ρi), and then the distance between the pair of feelers 41*a* and 41*b* is obtained from the obtained coordinates corresponding to the lens shape information (θi, ρi). The obtained distance is defined as an edge thickness Wi for the lens shape information (θi, σi).

Note that the moving amount of the measurement shaft (support shaft) 42*a* in the transverse direction is read out by a reading sensor (not shown) contained within the measuring unit 42. As the reading sensor, a linear scale, a magnescale, a slide resistor, a potentiometer or the like can be employed.

In order that the feelers 41*a* and 41*b* are brought into contact with the eyeglass lens ML and the moving amount is detected by use of the moving amount reading sensor (contained in the measuring unit 42) connected to the feelers 41*a* and 41*b*, the base 13 is advanced or retracted along the guide bars 19 and 20 in the transverse direction by the control of the drive motor 14, and the eyeglass lens ML is thereby moved integrally with the base 13 and the carriage 22 in the transverse direction with respect to the edge thickness measuring section 18 provided on the base 13. The feeler 41*a* or 41*b* is allowed to abut the front or rear refracting surface of the eyeglass lens ML. Furthermore, while the eyeglass lens ML is controlled in rotation thereof at each angle θi, the measurement is started by keeping the feeler 41*a* or 41*b* contact with the eyeglass lens ML.

(Control Circuit)

Figure 11:
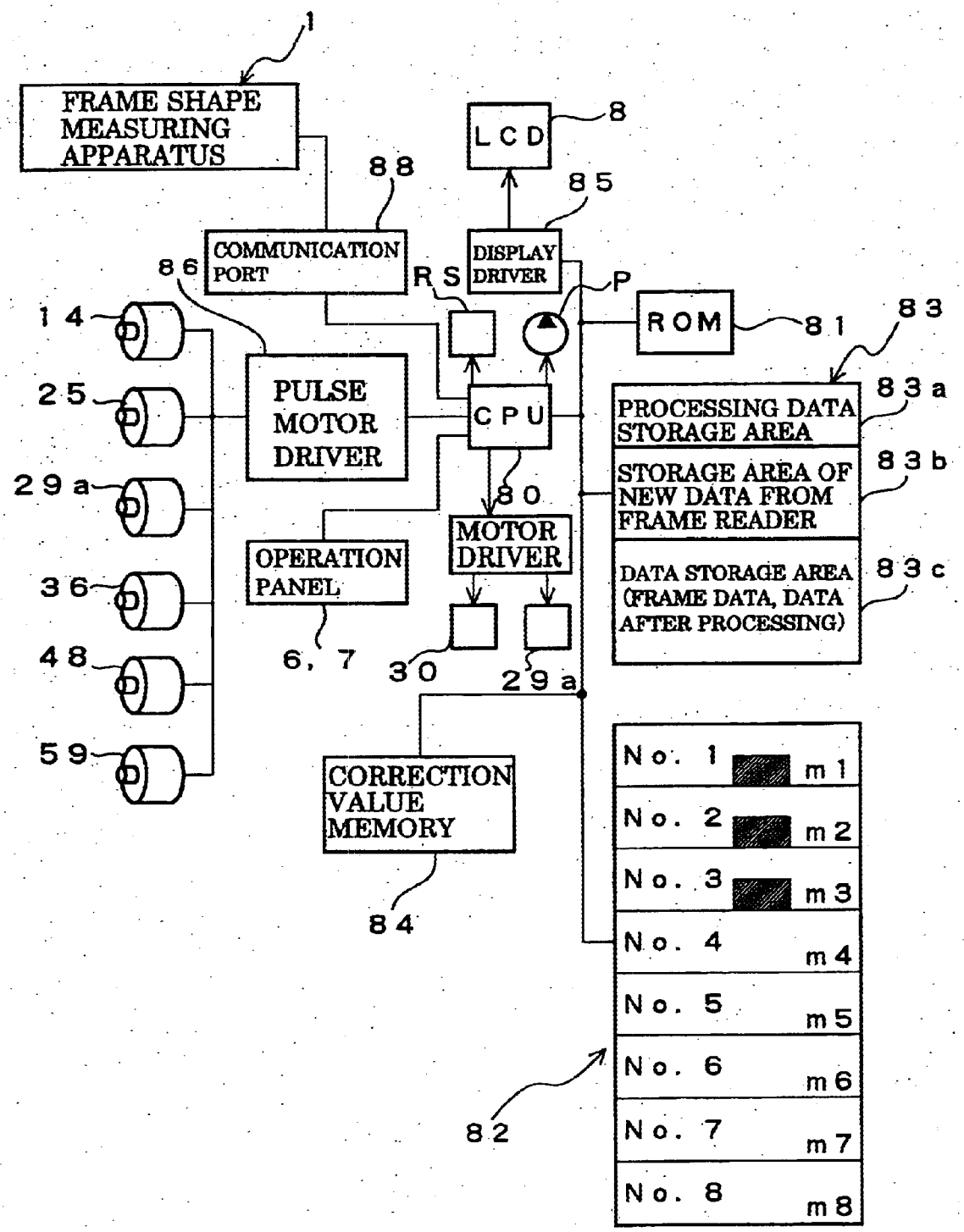
FIG. 11 is a control circuit diagram of the lens grinding apparatus shown in FIG. 1 to FIG. 9.

The above-described operation panels 6 and 7, that is, the switches of the operation panels 6 and 7 are connected to an arithmetic control circuit 80 including a CPU as shown in FIG. 11. Moreover, the arithmetic control circuit 80 is connected to a ROM 81 as storage means, a data memory 82 as storage means, a RAM 83 and a correction value memory 84.

Furthermore, the arithmetic control circuit 80 is connected to the liquid crystal display device 8 via a display driver 85 and to a pulse motor driver 86. The pulse motor driver 86 is controlled in motion thereof by the arithmetic control circuit 80 to control the motion (drive) of the various kinds of drive motors in the grinding portion 10, that is, the base drive motor 14, the lens shaft drive motor 25, the swing arm drive motor 36, the mover displacement motor 48, the pulse motor 59 or the like. Note that pulse motors are used for the base drive motor 14, the lens shaft drive motor 25, the swing arm drive motor 36, the mover displacement motor 48 and the like The arithmetic control circuit 80 is further connected to the grinding wheel drive motor 30 and the drive motor 39*a* via the motor driver 86*a,* as well as is connected to the rotary solenoid RS and the grinding fluid supply pump (grinding fluid supply means) P. The grinding fluid supply pump P is designed to supply the filtered grinding fluid from a waste-water tank (not shown) to the grinding fluid supply nozzles 60 and 61 in activation thereof.

Furthermore, the arithmetic control circuit 80 is connected to the frame shape measuring apparatus 1 in FIG. 1 via a communication port 88 to receive the lens shape data such as the frame shape data and the lens shape data from the frame shape measuring apparatus (lens shape measuring apparatus) 1.

In addition, the moving amount detecting signals from the measuring unit (moving amount detecting sensor) 42 are inputted into the arithmetic control circuit 80, The arithmetic control circuit 80 determines each of the coordinate positions of the front refracting surface (the left surface of the eyeglass lens in FIG. 7) of the eyeglass lens ML and the rear refracting surface (the right surface of the eyeglass lens in FIG. 7) thereof at the lens shape data (θi, ρi), based on a drive pulse for the base drive motor 14, drive pulses for the lens shaft drive motor 25, the pulse motor 59 and the like, which are controlled in motion thereof based on the lens shape data (θi, ρi) from the frame shape measuring apparatus 1, the detecting signals (detecting signals of feeler moving amount) from the measuring unit 42, or the like. Subsequently, the arithmetic control circuit 80 determines the edge thickness Wi at the lens shape data (θi, ρi) by calculation from the determined coordinate positions of the front and rear refracting surfaces of the eyeglass lens ML.

Figure 12:
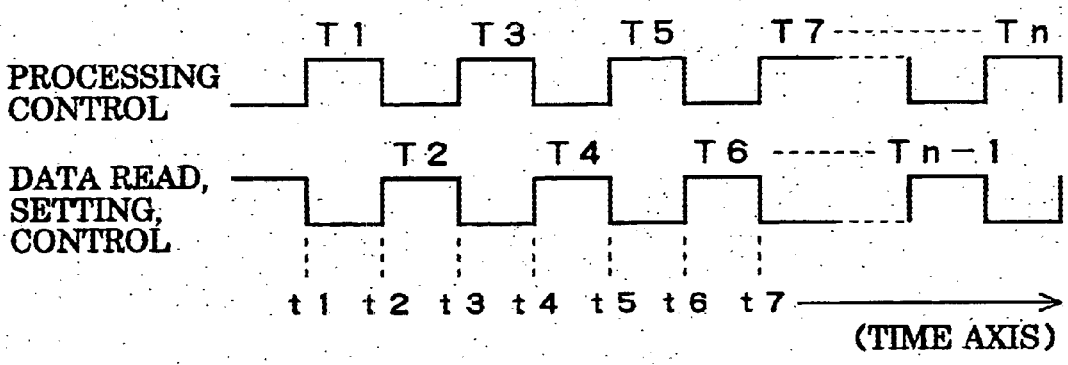
FIG. 12 is a time chart for explaining a control of the control circuit of FIG. 11.

When the arithmetic control circuit 80 reads out data from the frame shape measuring apparatus 1 or reads out data stored in storage areas m1 to m8 of the data memory 82 after starting control of processing, as shown in FIG. 12, the arithmetic control circuit 80 performs the control of processing and the control of the data reading or the layout setting in a time-sharing mode.

Specifically, when a period between time t1 and t2 is T1, a period between time t2 and t3 is T2, a period between time t3 and t4 is T3, . . . , a period between time tn−1 and tn is Tn, the control of processing is performed during the periods T1, T3, . . . , and Tn, and the control of the data reading and the layout setting are performed during the periods T2, T4, . . . , Tn−1. Accordingly, during the grinding of the processed lens, the reading and storing of the next plurality of lens shape data, the data reading, the layout setting (adjustment) or the like can be performed, thus considerably improving an work efficiency of data processing.

Various kinds of programs for controlling the operations of the lens grinding apparatus 2 are stored in the above-described ROM 81. The data memory 82 is provided with the plurality of data storage areas. Moreover, the RAM 83 is provided with: a processing data storage area 83*a* for storing the processing data for the lens currently in processing; a new data storage area 83*b* for storing new data; and a data storage area 83*c* for storing the frame data, data for the lens already processed, or the like.

Note that, as the data memory 82, a readable and writable flash EEPROM (FEEPROM) can be employed, or a RAM using a backup power supply can be employed, in which the content thereof cannot be erased even when the main power supply is turned off.

[Operations ]

Next, description will be made for operations of the lens grinding apparatus including the arithmetic control circuit 80 having such a constitution.

<Reading of Lens Shape Data>

In a starting stand-by state, when the main power supply is turned on, the arithmetic control circuit 80 judges as to whether or not data reading from the frame shape measuring apparatus 1 is to be carried out.

Specifically, the arithmetic control circuit 80 judges as to whether or not the "data request" switch 7*c* on the operation panel 6 is pressed. When the "data request" switch 7*c* is pressed for requesting data, data of the lens shape information (θi, ρi) is read from the frame shape measuring apparatus 1 into the data reading area 83*b* of the RAM 83. The read data is stored (recorded) in any one of the storage areas m1 to m8 of the data memory 82, and then the layout screen is displayed on the liquid crystal display device 8.

<Processing Circumferential Edge of Eyeglass Lens>

The measuring element 41 is in a standing position as shown in FIG. 7 before the measurement of the eyeglass lens ML held between the lens shafts 23 and 24. In such a position, the eyeglass lens ML held between the lens shafts 23 and 24 corresponds to a space between the feelers 41*a* and 41*b* of the measuring element 41. In such a state, by pressing the "right" switch 6*c* or the "left" switch 6*b*, a processing operation is started, such as the edge thickness measurement, the V-groove setting, and the grinding of the eyeglass lens ML.

(Calculation of Edge Thickness Wi)

With the foregoing state, the arithmetic control circuit 80 controls the motion of the rotary solenoid RS to lay down the measuring element 41 in the horizontal position as shown in FIG. SA, thus starting the calculating operation of the edge thickness.

Specifically, the arithmetic control circuit 80 controls the motion of the pulse motor driver 86 to normally operate the pulse motor 59, and thereby normally rotates the screw shaft 58 with the pulse motor 59. The stage 73 is then elevated along the guide rails 57 and 67 with the screw shaft 58, so that the lens shaft holder 74 is integrally elevated with the stage 73. Accordingly, the carriage 22 is swung around the carriage swing shaft 21, and the eyeglass lens ML between the lens shafts 23 and 24 is moved between the feelers 41*a* and 41*b* of the measuring element 41.

Subsequently, the arithmetic control circuit 80 controls the motion of the base drive motor 14 via the pulse motor driver 86 to make the one feeler 41*a* of the measuring element 41 abut the surface (front refracting surface) of the eyeglass lens ML. The arithmetic control circuit 80 then controls the motion of the lens shaft drive motor 25 with the pulse motor driver 86 to rotate the lens shafts 23 and 24 and the eyeglass lens ML at each predetermined angle θi (i=0, 1, 2, . . . n). Furthermore, the arithmetic control circuit 80 controls the motion of the pulse motor 59 with the pulse motor driver 86 to move the one feeler 41*a* of the measuring element 41 to the position of the radius vector ρi at the angle θi (i=0, 1, 2, . . . n). In such a manner, the arithmetic control circuit 80 sequentially changes the abutment position of the feeler 41*a* on the eyeglass lens ML based on the lens shape data, that is, the lens shape information (θi, ρi).

At this time, the measuring element 41 is moved in the transverse direction, and the moving amount is detected and outputted by the measuring unit 42. The detecting signals from the measuring unit 42 is inputted into the arithmetic control circuit 80. The arithmetic control circuit 80 determines the coordinate position of the front refracting surface (left surface of the eyeglass lens in FIG. 7) of the eyeglass lens ML at the lens shape information (θi, ρi) from the drive pulses of the base drive motor 14, the lens shaft drive motor 25, and the pulse motor 59, the detecting signals (detecting signals of the feeler moving amount) or the like, and then stores (records) the determined coordinate position in any one of the storage areas m1 to m8 of the data memory 82.

Similarly, the arithmetic control circuit 80 makes the other feeler 41*b* of the measuring element 41 abut the rear surface (rear refracting surface) of the eyeglass lens ML. The arithmetic control circuit 80 determines the coordinate position of the rear refracting surface (right surface of the eyeglass lens in FIG. 7) of the eyeglass lens ML corresponding to the lens shape information (θi, ρi), and stores (records) the determined coordinate position in any one of the storage areas m1 to m8 of the data memory 82.

Subsequently, the arithmetic control circuit 80 determines the edge thickness by calculation from the determined coordinate positions of the front and rear refracting surfaces of the eyeglass lens ML for the lens shape information (θi, ρi).

Thereafter, the arithmetic control circuit 80 controls and operates the rotary solenoid RS to stand the measuring element 41.

(V-Groove Setting)

When the edge thickness Wi is determined in such a manner, the arithmetic control circuit 80 determines the V-groove position at the lens shape information (θi, ρi) of the eyeglass lens ML in a predetermined ratio and stores (records) the determined V-groove position in any one of the storage areas m1 to m8 of the data memory 82. Since the V-groove position can be determined by use of a known method, detailed description thereof will be omitted.

(Calculation of Processing Data)

After the V-groove setting, the arithmetic control circuit 80 determines the processing data (θi', ρi') of the eyeglass lens ML corresponding to the lens shape information (θi, ρi) from data such as a pupil distance PD based on a formula of the eyeglass lens and a frame geometrical center-to-center distance FPD, a raised amount or the like, and is stored in the processing data storage area 83*a*.

(Grinding)

After the calculation of the processing data, the arithmetic control circuit 80 controls the motion of the grinding wheel drive motor 30 with the motor driver 86*a* to control the drive of the grinding wheel 35 for the clockwise rotation in FIG. 6. The grinding wheel 35 includes the rough grinding wheel (flat grinding wheel), the grinding wheel for a V-groove, the finish grinding wheel or the like, as described above.

On the other hand, the arithmetic control circuit 80 controls the drive of the lens shaft drive motor 25 via the pulse motor driver 86 based on the processing data (θi', ρi') stored in the processing data storage area 83*a* in order to control the rotation of the lens rotation shafts 23 and 24 and the eyeglass lens ML counterclockwise in FIG. 6.

At this time, the arithmetic control circuit 80 first controls and operates the pulse motor driver 86 at the position where i=0 based on the processing data (θi', ρi') stored in the processing data storage area 83*a* in order to control the drive of the pulse motor 59. Accordingly, the screw shaft 58 is rotated reversely, and the stage 73 is lowered by a predetermined amount. With the lowering of the stage 73, the lens shaft holder 74 is integrally lowered with the stage 73 by the own weight of the carriage 22 and the spring force of the spring 54 in the processing pressure adjusting mechanism 45.

After the unprocessed circular eyeglass lens ML abuts the grinding surface 35*a* of the grinding wheel 35 by the own weight of the carriage 22 and the spring force of the spring 54 in the processing pressure adjusting mechanism 45, only the stage 73 is lowered. When the stage 73 is separated downward from the lens shaft holder 74 by such lowering, the separation is detected by the sensor S, and the detecting signals from the sensor S are inputted into the arithmetic control circuit 80. On receiving the detecting signals from the sensor S, the arithmetic control circuit 80 further controls the drive of the pulse motor 59 to slightly lower the stage 73 by the predetermined amount.

Accordingly, the eyeglass lens ML is ground with the grinding wheel 35 by the predetermined amount at the processing data (θi', ρi') where i=0. When the lens shaft holder 74 is lowered with the grinding to abut the stage 73, the sensor S detects the abutment to output the detecting signals, and then the detecting signals are inputted into the arithmetic control circuit 80.

On receiving the detecting signals, the arithmetic control circuit 80 allows the eyeglass lens ML to be ground by the grinding wheel 35 in a manner that the case where i=1 of the processing data (θi', ρi') is similar to that where i=0 thereof. The arithmetic control circuit 80 performs such control until i=n (360°), so that the circumferential edge of the eyeglass lens ML is ground by the rough grinding wheel (not given the reference numeral) of the grinding wheel 35 to be the radius vector ρi' for each angle θi' of the processing data (θi', ρi').

In such grinding, the arithmetic control circuit 80 activates the grinding fluid supply pump P to discharge the grinding fluid 62 from the first grinding fluid outlet (first grinding fluid supply means) 63 of the grinding fluid discharge nozzle 61, and to discharge the grinding fluid 64 from the second grinding fluid outlet (second grinding fluid supply means) 65 of the grinding fluid discharge nozzle 61.

At this time, the grinding fluid 64 is supplied to the grinding surface 35*a* of the grinding wheel 35 in the normal direction. The grinding fluid 64 is sufficiently flown down on the lens grinding portion 69 side with the rotation of the grinding wheel 35 to sufficiently cool the lens grinding portion 69, and is obliquely scattered downward to the rear side with the grinding chips 70 of the eyeglass lens ML ground at the lens grinding portion 69. Furthermore, since the sufficient grinding fluid 64 is sufficiently supplied over the entire width of the grinding wheel 35, even when the contact position of the eyeglass lens ML with the grinding wheel 35 is displaced in the transverse direction, a shortage of the grinding fluid supplied to the lens grinding portion 69 cannot be caused.

The grinding fluid 62 discharged from the first grinding fluid outlet (first grinding fluid supply means) 63 of the grinding fluid discharge nozzle 61 is directed in the direction parallel to the tangent line of the grinding wheel 36 and to the rear side of the processing chamber 4, and covers the lens grinding portion 69 on the eyeglass lens ML side between the grinding wheel 35 and the lens shafts 23 and 24 in a curtain shape. Furthermore, at this time, the grinding fluid 62 covers the entire width of the upper portion and the rear portion of the grinding wheel 35 and is discharged from the second grinding fluid outlet (second grinding fluid supply means) 65 in the grinding wheel 35. Even when a part of the grinding fluid 64 moved toward the rotating direction of the grinding wheel 35 is scattered rearward by the rotation of the grinding wheel 35, the leak (scattering) thereof to the upper portion of the processing chamber 4 or the arc-shaped bottom wall 11*e*1 side can be prevented. Accordingly, the cover 5 or the arc-shaped bottom wall 11*e*1 can be prevented from being dirty. Moreover, since the guide slits 11*a*1 and 11*b*1 are covered with the cover plates 11*a*2 and 11*b*2, even when the grinding chips are scattered toward the side walls 11*a* and 11*b* with the grinding fluid during the grinding of the eyeglass lens ML with the grinding wheel 35, the grinding chips or the grinding fluid can be prevented from leaking out through the guide slits 11*a*1 and 11*b*1.

Note that, as for the supply of the grinding fluid to the grinding surface 35*a* in the normal direction, the supply direction of the grinding fluid is not limited as long as the grinding fluid does not splash out beyond the grinding fluid discharged in the tangent direction of the grinding wheel 35 and is directly discharged to the grinding surface 35*a*. Such grinding fluid 62 and 64, grinding chips 70 or the like are mostly flown down to the lower bottom wall 11*e*2 and then flown through the drain 11*f* into the not-shown wastewater tank to be collected.

On the other hand, the arithmetic control circuit 80 activate the grinding fluid supply pump P to discharge the grinding fluid 71 from the grinding fluid discharge nozzle 60 to the center of the arc-shaped bottom wall 11 *e*1 to spread in the transverse direction in a fun shape. The grinding fluid 71 is flown down from the center of the upper end of the arc-shaped bottom wall 11*e*1 in the transverse direction to spread in the transverse direction. Accordingly, even when a part of the grinding chips 70 or the grinding fluid 62 is scattered to the lower potion of the arc-shaped bottom wall 11*e*1, such grinding chips 70 or the grinding fluid 62 is washed off downward by the grinding fluid 71 flowing down, and is flown down through the drain 11*f* into the not-shown waste fluid tank to be collected.

In an approximately similar manner, the arithmetic control circuit 80 performs V-groove processing for the circumferential edge of the eyeglass lens ML, which has been subjected to the rough grinding to be a shape indicated by the processing data (θi', ρi'), with the grinding wheel for a V-groove (not given the reference numeral) of the grinding wheel 35. At this time, the grinding fluid is discharged in the same manner as that in the above-described grinding with the rough grinding wheel. The grinding wheel 35 includes the rough grinding wheel and the grinding wheel for a V-groove, which are arranged side by side in the transverse direction, and the contact position of the eyeglass lens ML with the grinding wheel 35 is moved from the contact position in the right and left direction during the rough grinding and the V-groove processing. However, in such a case, the grinding fluid 64 is sufficiently supplied over the entire width of the grinding wheel 35. Accordingly, in the case of the rough grinding of the circumferential edge of the eyeglass lens ML with the rough grinding wheel of the grinding wheel 35, and also in the case of the V-groove processing of the circumferential edge of the eyeglass lens ML, which has been subjected to the rough grinding, with the grinding wheel for a V-groove adjacent to the rough grinding wheel of the grinding wheel 35, a shortage of the grinding fluid supplied to the lens grinding portion 69 cannot be caused.

[Effects of the Invention]

As described above, according to claims 1 and 2 of the present invention, even when the grinding apparatus is designed so that the grinding fluid directly lashes the grinding wheel, splashing of the grinding fluid can be prevented, and the sufficient grinding fluid can be supplied to the both of the eyeglass lens ML as a material to be ground and the grinding surface of the grinding wheel. Particularly in the grinding of the eyeglass lens or the like, the problem can be solved, in which the grinding fluid does not sufficiently spread over both of the grinding wheel and the eyeglass lens or the like as a material to be ground because of a slight dislocation in the tangent direction between the eyeglass lens or the like and the grinding wheel, thus causing a shortage of the grinding fluid. Even when the processing point of the grinding wheel is moved because of the difference in the finished shape (lens shape) of the eyeglass lens or the like, the grinding fluid can be supplied by following the moving processing point.

Furthermore, since the first and the second grinding fluid supply means are united, the entire apparatus can be made small and compact.

What is claimed is:

1. A grinding fluid supply device of a lens grinding apparatus, comprising:

first grinding fluid supply means for supplying a grinding fluid in a tangent direction of a circular grinding wheel, which has a grinding surface formed on its circumferential surface, with a space above a grinding surface and allows an upper portion and a rear side portion of the grinding surface to be covered with a curtain of the grinding fluid spaced from the grinding wheel when a processed lens is subjected to a grind processing with the grinding surface of the grinding wheel by rotatively driving the grinding wheel around an axis; and second grinding fluid supply means for insufflating the grinding fluid to the grinding surface.

2. A grinding fluid supply device of a lens grinding apparatus according to claim 1, wherein said first and second grinding fluid supply means are integrally formed.

3. A grinding fluid supply device of a lens grinding apparatus according to claim 1, wherein said first grinding fluid supply means discharges the grinding fluid in an arc shape along the grinding surface.

4. A grinding fluid supply device of a lens grinding apparatus according to claim 1, wherein said first and second grinding fluid supply means are integrally formed and said first grinding fluid supply means discharges the grinding fluid in an arc shape along the grinding surface.

5. A grinding fluid supply device of a lens grinding apparatus according to claim 1, wherein said second grinding fluid supply means insufflates the grinding fluid to the grinding surface from a normal direction.

6. A grinding fluid supply device of a lens grinding apparatus according to claim 1, wherein said first grinding fluid supply means discharges the grinding fluid in an arc shape along the grinding surface and said second grinding fluid supply means insufflates the grinding fluid to the grinding surface from a normal direction.

7. A grinding fluid device of a lens grinding apparatus according to claim 1, wherein a width of the grinding fluid discharged from said first grinding fluid supply means is larger than that of the grinding fluid discharged from said second grinding fluid supply means.

8. A grinding fluid supply device of a lens grinding apparatus according to claim 1, wherein a width of the grinding fluid discharged from said second grinding fluid supply means is made approximately equal to that of the grinding surface or larger than that of the grinding surface.

9. A grinding fluid supply device of a lens grinding apparatus according to claim 1, further comprising:

third grinding fluid supply means for discharging a grinding fluid to a bottom wall in a width direction of the bottom wall of a processing chamber, and for flowing the discharged grinding fluid to the grinding wheel side along the bottom wall, the third grinding fluid supply means being provided at a lower edge portion of a rear wall of the processing chamber where the grinding wheel is disposed.

10. A grinding fluid supply device of a lens grinding apparatus according to claim 9, wherein said third grinding fluid supply means is a grinding fluid discharge nozzle provided at a center of the rear wall in a transverse direction.

11. A grinding fluid supply device of a lens grinding apparatus according to claim 9, wherein said first and second grinding fluid supply means are integrally formed.

12. A grinding fluid supply device of a lens grinding apparatus according to claim 9, wherein said third grinding fluid supply means is a grinding fluid discharge nozzle provided at a center of the rear wall in a transverse direction and said first and second grinding fluid supply means are integrally formed.

* * * * *